US006802502B2

(12) United States Patent
Hasegawa et al.

(10) Patent No.: US 6,802,502 B2
(45) Date of Patent: Oct. 12, 2004

(54) DOCUMENT BINDING APPARATUS

(75) Inventors: Takao Hasegawa, Tokyo (JP); Katsunori Manabe, Tokyo (JP)

(73) Assignee: Max Co., Ltd., Tokyo (JP)

( * ) Notice: Subject to any disclaimer, the term of this patent is extended or adjusted under 35 U.S.C. 154(b) by 120 days.

(21) Appl. No.: 10/071,227

(22) Filed: Feb. 11, 2002

(65) Prior Publication Data

US 2002/0109283 A1 Aug. 15, 2002

(30) Foreign Application Priority Data

Feb. 14, 2001 (JP) ..... P2001-037764
Feb. 14, 2001 (JP) ..... P2001-037765
Feb. 14, 2001 (JP) ..... P2001-037766
Feb. 14, 2001 (JP) ..... P2001-037767
Feb. 14, 2001 (JP) ..... P2001-037768
Feb. 14, 2001 (JP) ..... P2001-037771
Feb. 14, 2001 (JP) ..... P2001-037773

(51) Int. Cl.[7] ..... B65H 33/04
(52) U.S. Cl. ..... 270/58.12
(58) Field of Search ..... 270/58.08, 58.11, 270/58.12

(56) References Cited

U.S. PATENT DOCUMENTS 5,895,036 A * 4/1999 Asao ..... 270/58.09
6,098,975 A * 8/2000 Kobayashi ..... 270/58.09
6,120,020 A * 9/2000 Asao ..... 271/189
6,357,736 B1 * 3/2002 Kubota et al. ..... 270/58.08
6,398,214 B1 * 6/2002 Moteki et al. ..... 271/220
6,427,997 B1 * 8/2002 Hirota et al. ..... 270/58.12

FOREIGN PATENT DOCUMENTS

JP 10279169 A * 10/1998 ..... B65H/37/04

* cited by examiner

*Primary Examiner*—Christopher P. Ellis
*Assistant Examiner*—Mark A. Deuble
(74) *Attorney, Agent, or Firm*—Morgan, Lewis & Bockius, LLP

(57) ABSTRACT

A document binding apparatus is formed to be mounted on an upper surface of a laser beam printer or the like. A paper discharged from the printer is fed to a paper guide, and a paper detecting sensor is turned ON to start the document binding apparatus. The paper is fed to a binding table through a paper lead-in roller, and a paper arranging pusher and a paper arranging rotation brush arrange the paper put on the binding table and an electromotive stapler binds the paper. After the staple process, a paper discharge roller holds the paper and discharges it to a stack tray.

36 Claims, 20 Drawing Sheets

DOCUMENT BINDING APPARATUS

BACKGROUND OF THE INVENTION

1. Field of the Invention

The present invention relates to a document binding apparatus constituted to be connected to a printer apparatus such as a page printer, a copying machine or a facsimile and to automatically bind a print paper discharged from the printer apparatus.

More specifically, the present invention relates to the following with respect to a document binding apparatus:

- a paper feeding mechanism of a document binding apparatus which leads in a paper and discharges the paper after binding by means of one motor;
- a paper feeding mechanism of a document binding apparatus which can enhance the stability of paper feed;
- a paper arranging mechanism of a document binding apparatus in which positions are arranged in longitudinal and transverse directions by means of one motor;
- a document binding apparatus to bind a document with a fixed electromotive stapler; and
- a binding table of a document binding apparatus for preventing misalignment of a paper.

2. Description of the Related Art

It is convenient that a printer apparatus such as a page printer, a facsimile or a copying machine has a document binding function of automatically binding and discharging a printed document. A large-sized copying machine having an electromotive stapler provided therein and serving to carry out a document binding process has already been put into practical use. It is supposed that a document binding apparatus having a simple structure which can be externally attached to the printer apparatus can enhance a business processing efficiency. In the case in which such a document binding apparatus is to be concretely implemented; however, it is a matter of course that the size of a mechanism section should be reduced as much as possible. Further, it is necessary to have a structure capable of removing a jammed paper as a countermeasure to be taken against a paper jamming accident in addition to a document binding function.

SUMMARY OF THE INVENTION

A technical problem to be solved arises in order to provide a document binding apparatus which can be connected to the printer apparatus as described above and the invention has a first object to solve the problem.

Further, there is a technical problem to be solved in order to provide a paper feeding mechanism having a reasonable structure suitable for a reduction in the size of the document binding apparatus, and the invention has a second object to solve the problem.

When concretely implementing such a document binding apparatus, it is necessary to provide a paper lead-in roller mechanism for feeding a paper discharged from a printer apparatus onto a binding table and a paper discharge roller mechanism for discharging the bound paper from a document binding apparatus process table. In a mechanism for holding and feeding a paper between a pair of rollers, however, when the termination of the paper passes through the pair of rollers so that feeding force is not applied, the paper is stopped. Consequently, there is a possibility that the paper might be incompletely fed into the binding table and might be incompletely discharged from the binding table.

Therefore, there is a technical problem to be solved in order to reliably feed the paper to a predetermined position, and the invention has a third object to solve the problem.

Moreover, there is a technical problem to be solved in order to provide a paper arranging mechanism having a reasonable structure suitable for a reduction in the size of the document binding apparatus, and the invention has a fourth object to solve the problem.

Further, when concretely implementing such a document binding apparatus, as mentioned above, it is necessary to reduce the size of a mechanism section as much as possible. A copying machine with a conventional document binding function has such a structure that an electromotive stapler is moved with respect to a paper arranged on a binding table or the paper is moved to the position of the electromotive stapler and is thus arranged. Consequently, there is a problem in that a mechanism for moving the electromotive stapler or a mechanism for moving the paper is required, resulting in a complexity and large size of a paper binding mechanism.

Therefore, there is a technical problem to be solved in order to provide a small-sized document binding apparatus which can be externally attached to a printer apparatus, and the invention has a fifth object to solve the problem.

Moreover, when concretely implementing such a document binding apparatus, a paper discharged from a printer apparatus is sequentially led onto a binding table in the document binding apparatus by means of a paper lead-in roller mechanism, and the led paper is arranged by a paper arranging mechanism and is bound by an electromotive stapler. In this case, generally, the surface of the binding table formed of plastics has a low coefficient of friction and is easy to slip. Therefore, when the paper is to be continuously fed onto the binding table, there is a possibility that a second paper might push a first paper put on the binding table forward and the position of the first paper might be shifted. If the inclination angle of the binding table is increased, there is no possibility that the misalignment might be caused. If the inclination angle is increased, the height of the document binding apparatus is increased, which is not preferable for the document binding apparatus requiring a reduction in a size.

Therefore, there is a technical problem to be solved in order to reduce the height of the document binding apparatus as much as possible and to prevent the misalignment of the paper put on the binding table, and the invention has a sixth object to solve the problem.

Further, there is a technical problem to be solved in order to provide a document binding apparatus capable of being externally attached to a printer apparatus and easily removing a paper in the case of a paper jam, and the invention has a seventh object to solve the problem.

The invention is proposed to attain the first object and provides a document binding apparatus formed to be externally attached to a printer apparatus such as a page printer, a facsimile or a copying machine, including: a paper lead-in roller mechanism for leading a paper discharged from the printer apparatus onto a binding table in the document binding apparatus; a paper arranging mechanism for aligning a position of the paper put on the binding table; an electromotive stapler for binding a vicinity of a corner portion of the paper put on the binding table; a paper discharge roller mechanism for discharging the paper put on the document binding table to a stack tray; and a control device for sequence controlling the paper lead-in roller mechanism, the paper arranging mechanism, the electromotive stapler and the paper discharge roller mechanism, wherein a series of operations are executed, in which the paper discharged from the printer apparatus is led onto the binding table and the paper put on the binding table is arranged, and the arranged paper is bound through a staple and the bound paper is discharged onto the stack tray.

Moreover, there is provided the document binding apparatus including control means provided with a sensor for detecting a paper discharged from the printer apparatus and serving to start the paper lead-in roller mechanism in response to an ON signal of the paper detecting sensor, to start the paper arranging mechanism in response to an OFF signal of the paper detecting sensor, to compare an OFF continuation time taken after the paper detecting sensor is turned OFF with a reference time, to start the electromotive stapler when the OFF continuation time exceeds the reference time, and to start the paper discharge roller mechanism after the staple process.

Furthermore, there is provided the document binding apparatus including control means for starting the electromotive stapler when the number of ON operations of the paper detecting sensor is two or more and the OFF continuation time taken after the paper detecting sensor is turned OFF exceeds the reference time, and for starting the paper discharge roller mechanism after the staple process.

In addition, the invention is proposed to attain the second object and provides a paper feeding mechanism of a document binding apparatus formed to be externally attached to a printer apparatus such as a page printer, a facsimile or a copying machine in which a paper discharged from the printer apparatus is sequentially led onto a binding table in the document binding apparatus through a paper lead-in roller mechanism, the led paper is arranged by a paper arranging mechanism and is bound by an electromotive stapler, and the bound paper is discharged by a paper discharge roller mechanism, wherein a gear train for driving a paper lead-in roller and a paper discharge roller by means of one paper feeding motor is provided, a gear is attached to a shaft of a rotatable link arm through a torque limiter, the gear is engaged with a gear for paper discharge, the paper discharge roller is attached to a tip portion of the link arm, and the gear and the paper discharge roller are coupled through power transmitting means such as an intermediate gear or a timing belt, wherein, when the paper feeding motor is rotated in a forward direction, the paper lead-in roller is rotated in a forward direction to lead in a paper and the tip of the link arm is rotated in such a direction as to separate from a paper feeding path so that the paper discharge roller separates from a driven roller for paper discharge, and wherein, when the paper feeding motor is reversely rotated, the tip of the link arm is rotated in a direction of the paper feeding path so that the paper discharge roller comes in contact with the driven roller for paper discharge by pressure and the paper discharge roller is rotated in a forward direction, thereby discharging the paper.

Moreover, the invention is proposed to attain the third object and provides a paper feeding mechanism of a document binding apparatus formed to be externally attached to a printer apparatus such as a page printer, a facsimile or a copying machine in which a paper discharged from the printer apparatus is sequentially led onto a binding table in the document binding apparatus by means of a paper lead-in roller mechanism, the led paper is arranged by a paper arranging mechanism and is bound by an electromotive stapler, and the bound paper is discharged by a paper discharge roller mechanism, wherein a paper lead-in driven roller provided in contact with a paper lead-in roller has a gear-shaped section.

Further, the invention is proposed to attain the fourth object and provides a paper arranging mechanism of a document binding apparatus formed to be externally attached to a printer apparatus such as a page printer, a facsimile or a copying machine in which a paper discharged from the printer apparatus is sequentially led onto a binding table in the document binding apparatus by means of a paper lead-in roller mechanism, the led paper is arranged by a paper arranging mechanism and is bound by an electromotive stapler, and the bound paper is discharged by a paper discharge roller mechanism, the paper arranging mechanism including:

a paper arranging pusher formed to be protruded from one of left and right wall surfaces of the binding table into the binding table and to be retreated therefrom; a cam mechanism for reciprocating the paper arranging pusher; a paper arranging rotation brush mechanism provided between left and right wall surfaces of the binding table; and a gear train for driving the cam mechanism and the paper arranging rotation brush mechanism by means of one motor, wherein a side surface of the paper introduced into the binding table is pushed by the paper arranging pusher to carry out alignment in a transverse direction and a surface of the paper is swept by the paper arranging rotation brush to carry out alignment in a longitudinal direction.

Moreover, the invention is proposed to attain the fifth object and provides a document binding apparatus formed to be attached to and removed from or to be provided in a printer apparatus such as a page printer, a facsimile or a copying machine in which a paper discharged from the printer apparatus is sequentially led onto a binding table in the document binding apparatus by means of a paper lead-in roller mechanism, and the led paper is arranged by a paper arranging mechanism and is bound by an electromotive stapler, and the bound paper is discharged by a paper discharge roller mechanism, wherein the electromotive stapler is fixed into such a position that it hits on a corner portion of the paper put on the binding table, and a side edge portion of the paper enters a portion between a clincher and a driver of the electromotive stapler and runs during the paper lead-in, and the corner portion of the paper accumulated on the binding table is bound by the electromotive stapler.

Further, the invention is proposed to attain the sixth object and provides a binding table of a document binding apparatus formed to be externally attached to a printer apparatus such as a page printer, a facsimile or a copying machine in which a paper discharged from the printer apparatus is sequentially led onto a binding table in the document binding apparatus by means of a paper lead-in roller mechanism, and the led paper is arranged by a paper arranging mechanism and is bound by an electromotive stapler, and the bound paper is discharged by a paper discharge roller mechanism, wherein a non-slip member having a high coefficient of friction such as a rubber sheet is stuck onto or coated over a surface of the binding table or a non-slip processing is directly carried out over the surface, thereby preventing misalignment of the arranged paper.

The invention is proposed to attain the seventh object and provides a document binding apparatus formed to be externally attached to a printer apparatus such as a page printer, a facsimile or a copying machine in which a paper discharged from the printer apparatus is sequentially led onto a binding table in the document binding apparatus by means of a paper lead-in roller mechanism, and the led paper is arranged by a paper arranging mechanism and is bound by an electromotive stapler, and the bound paper is discharged by a paper discharge roller mechanism, wherein a paper lead-in roller, a paper discharge roller and a paper arranging rotation brush are provided on an openable cover assembled into a main case of the document binding apparatus, and gears provided on respective shafts of the paper lead-in roller, the paper discharge roller and the paper arranging rotation brush are engaged with a gear for paper lead-in, a gear for paper discharge and a gear for paper arrangement which are provided in the main case to transmit a power in a state that the cover is closed.

Further, according to the present invention, a method of binding a document by a document binding apparatus externally attached to a printer apparatus is proposed. The method includes the steps of: leading a paper discharged from the printer apparatus; aligning a position of the paper; binding the paper; and discharging the paper, wherein said steps of leading the paper, aligning the position of the paper, binding the paper and discharging the paper are sequentially executed.

DETAILED DESCRIPTION OF THE PREFERRED EMBODIMENTS

Figure 1:
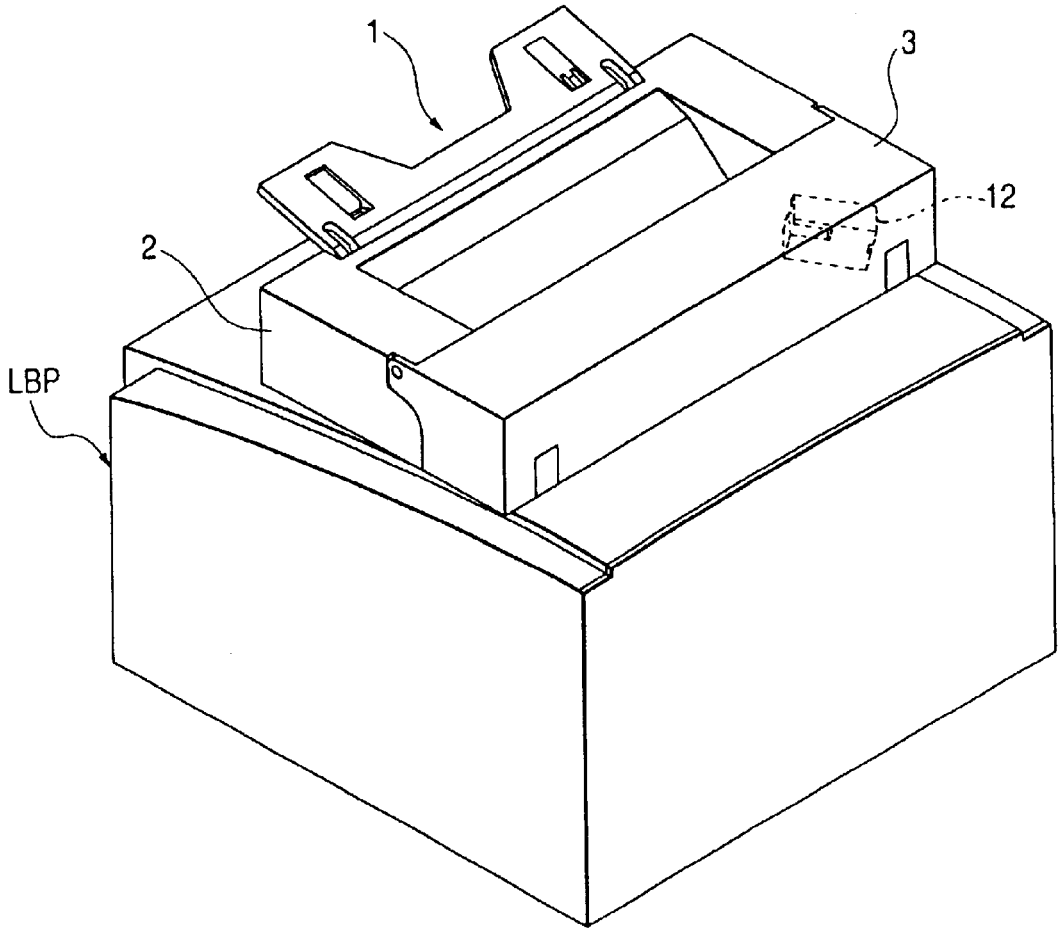
FIG. 1 is a perspective view showing a state that a document binding apparatus is mounted on a printer apparatus according to an embodiment of the invention.
Figure 2:
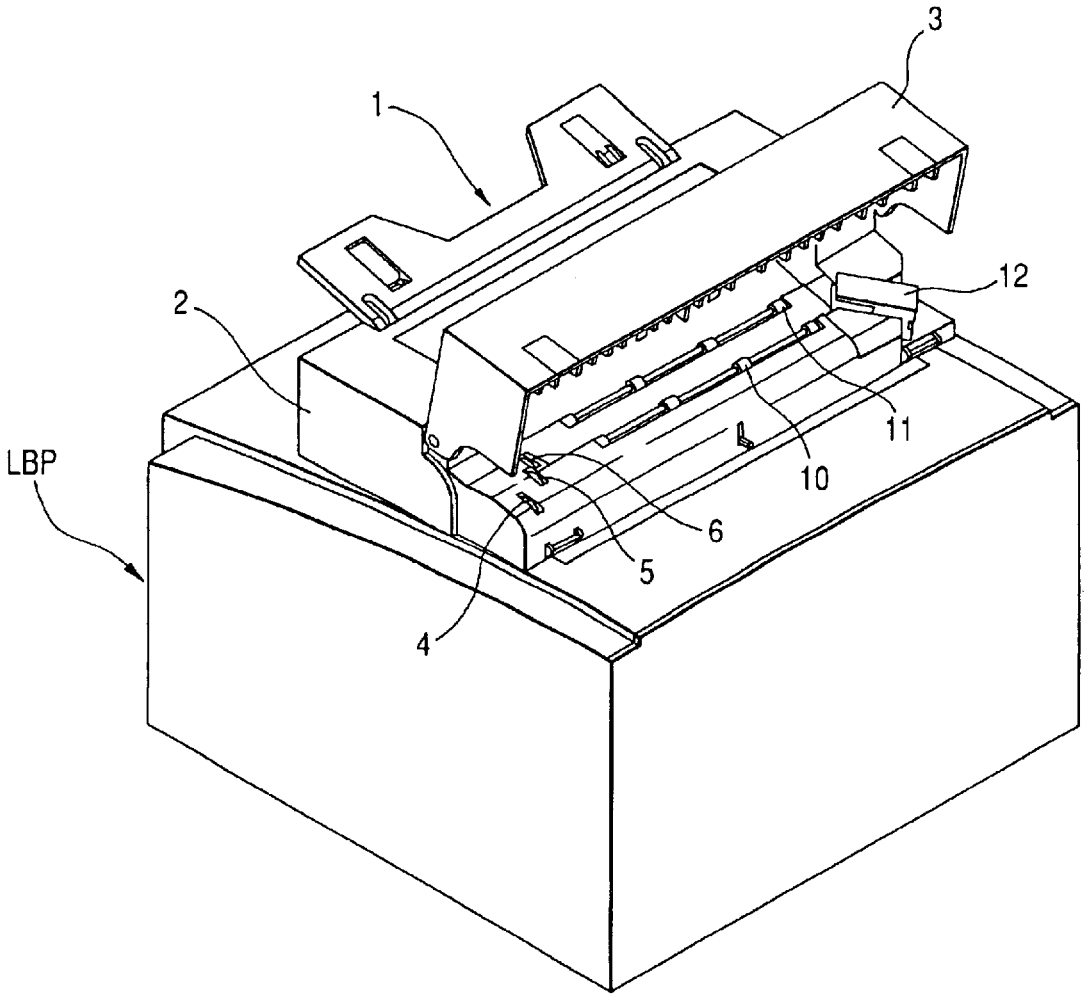
FIG. 2 is a perspective view showing a state that a cover of the document binding apparatus mounted on the printer apparatus is opened.
Figure 3:
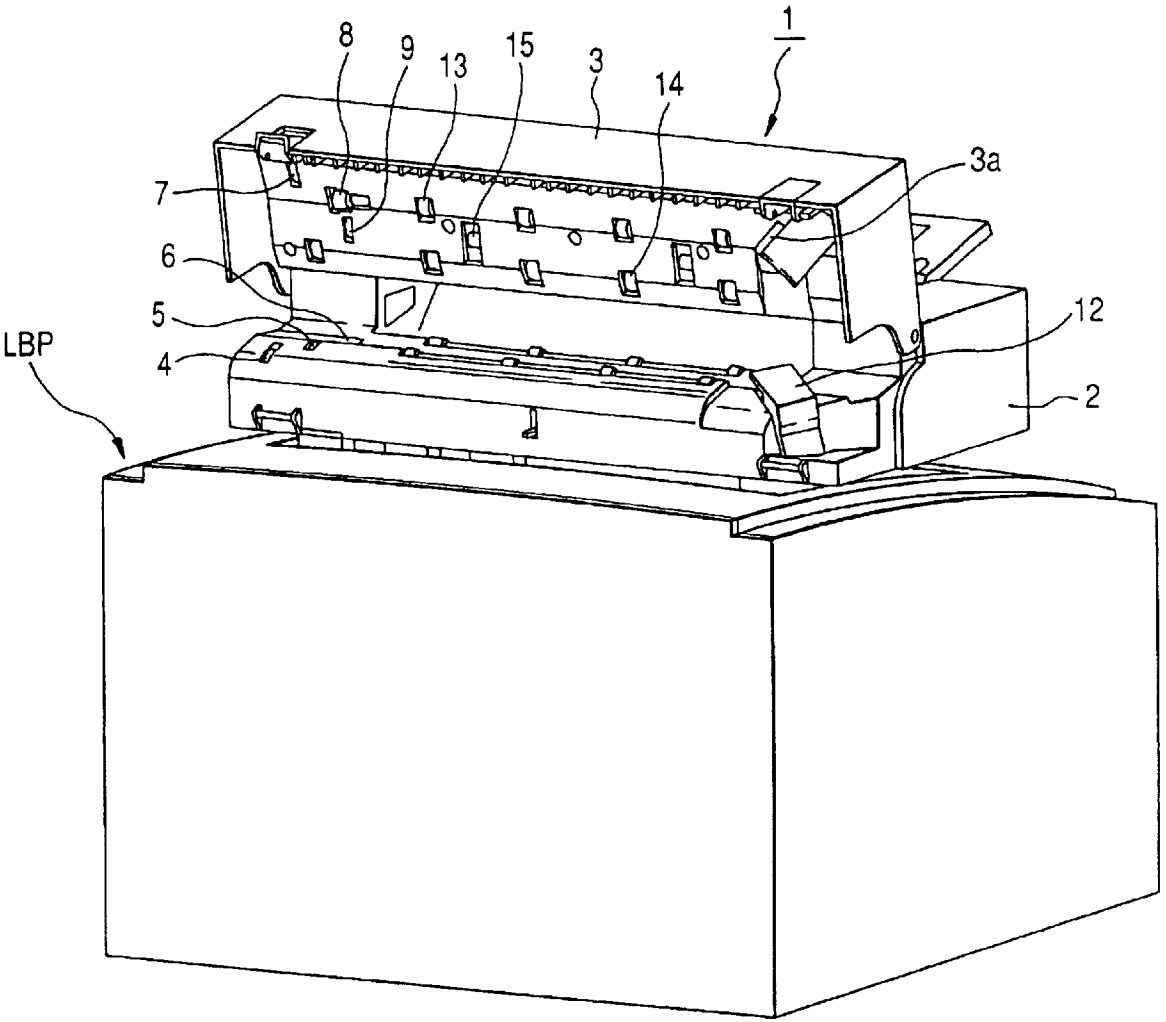
FIG. 3 is a perspective view showing a state that the cover of the document binding apparatus mounted on the printer apparatus is opened.

An embodiment of the invention will be described below in detail with reference to the drawings. FIGS. 1 to 3 are views showing a laser beam printer LBP and a document binding apparatus 1 as seen from the back side, and the document binding apparatus 1 is set onto the laser beam printer LBP and covers a paper discharge port on the upper surface of the laser beam printer LBP and a stack tray. A housing of the document binding apparatus 1 is constituted by a main case 2 and an openable cover 3 attached to the rear part of the main case 2, and the main case 2 includes a power section, a control circuit, a motor and the like.

As shown in FIG. 2, three gears seen in the vicinity of the left end of the main case 2 with the cover 3 opened are a gear 4 for paper discharge, a gear 5 for paper lead-in and a gear 6 for paper arrangement from the left, and the respective gears 4, 5 and 6 are engaged with gears 7, 8 and 9 provided on the cover 3 shown in FIG. 3 and transmit a power to the cover 3 side when the cover 3 is closed.

As shown in FIG. 2, two rollers 10 and 11 are provided in parallel with the main case 2, and an outside roller acts as a driven roller 10 for paper lead-in and an inside roller acts as a driven roller 11 for paper discharge. An electromotive stapler 12 provided in the vicinity of the right end of the main case 2 is attached at an angle of 45 degrees in a paper delivery direction in order to obliquely punch a staple in the corner portion of a document, and the edge portion of the paper passes through a portion between a clincher and a driver which are vertically opposed in the tip portion of the electromotive stapler 12.

As shown in FIG. 3, a paper lead-in roller 13 (an upper part in the drawing) and a paper discharge roller 14 (a lower part in the drawing) are provided on the internal surface of the cover 3 and a paper arranging rotation brush 15 formed of rubber is provided between the two rollers 13 and 14, and the respective gears 7, 8 and 9 on the left end are engaged with the gear 4 for paper discharge, the gear 5 for paper lead-in and the gear 6 for paper arrangement on the main case 2 side when the cover 3 is closed. Moreover, the back face of the cover 3 is provided with a rib-shaped paper guide 3*a* to be positioned immediately before the electromotive stapler 12 when the cover is closed.

Figure 4:
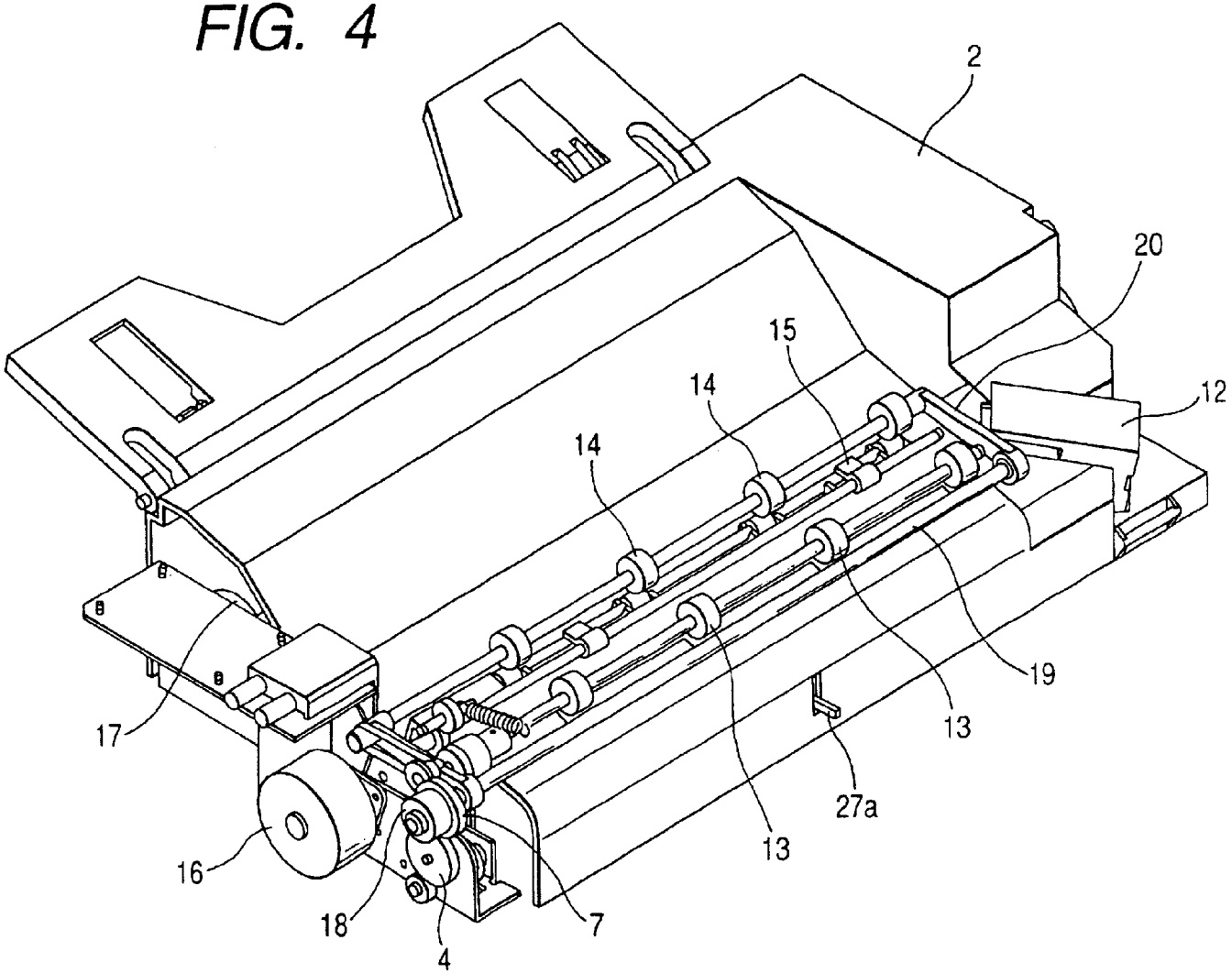
FIG. 4 is a perspective view showing an arrangement of a mechanism for the document binding apparatus.

FIG. 4 shows the positional relationship between a driving mechanism provided on the main case 2 side and the paper lead-in roller 13, the paper discharge roller 14 and the paper arranging rotation brush 15 which are provided on the cover 3 side, and 16 denotes a paper feeding motor for driving the paper lead-in roller 13 and the paper discharge roller 14 and a part of a paper arranging motor 17 is shown ahead thereof (on the left in the drawing).

Figure 5:
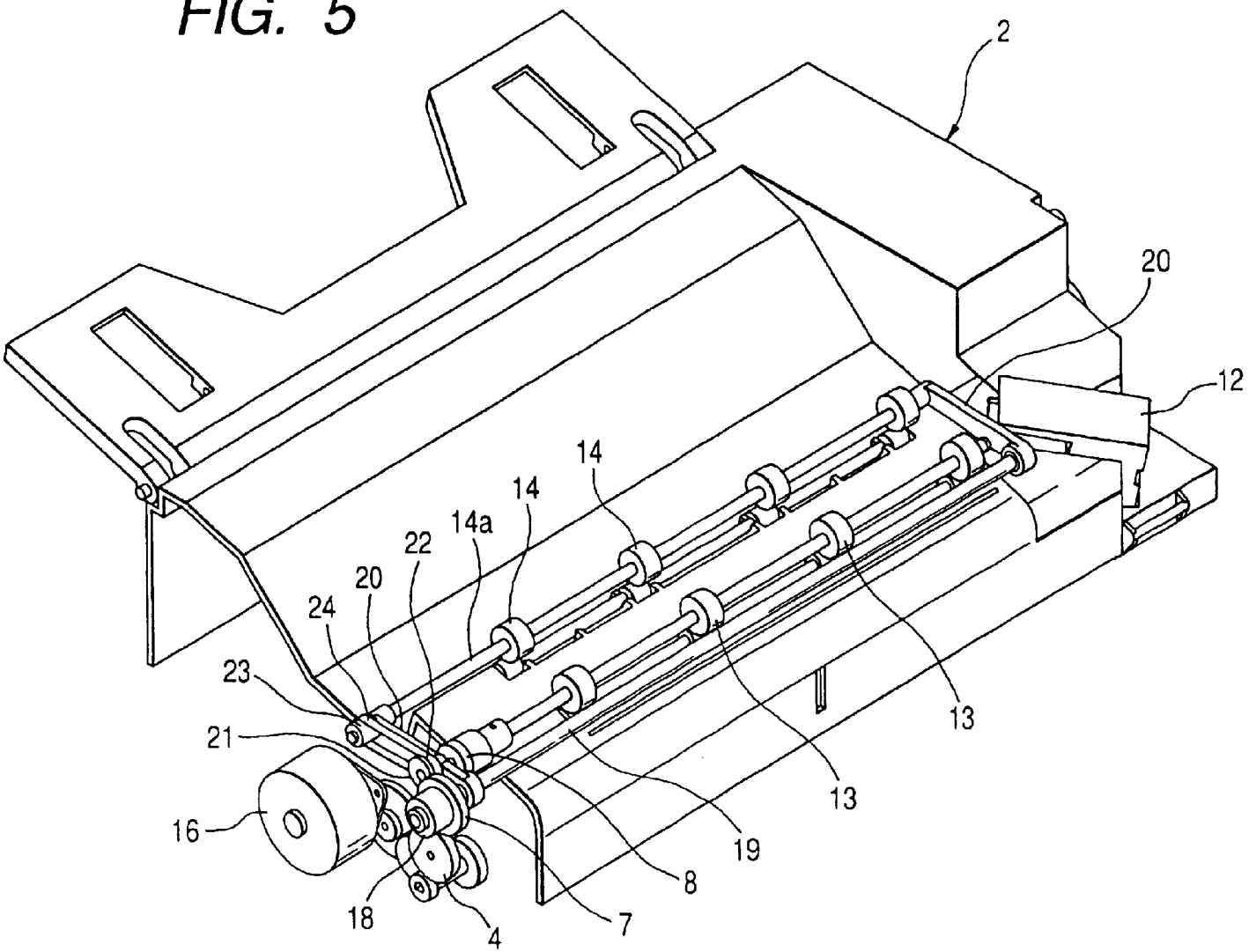
FIG. 5 is a perspective view showing a paper lead-in mechanism and a paper discharge mechanism.
Figure 9:
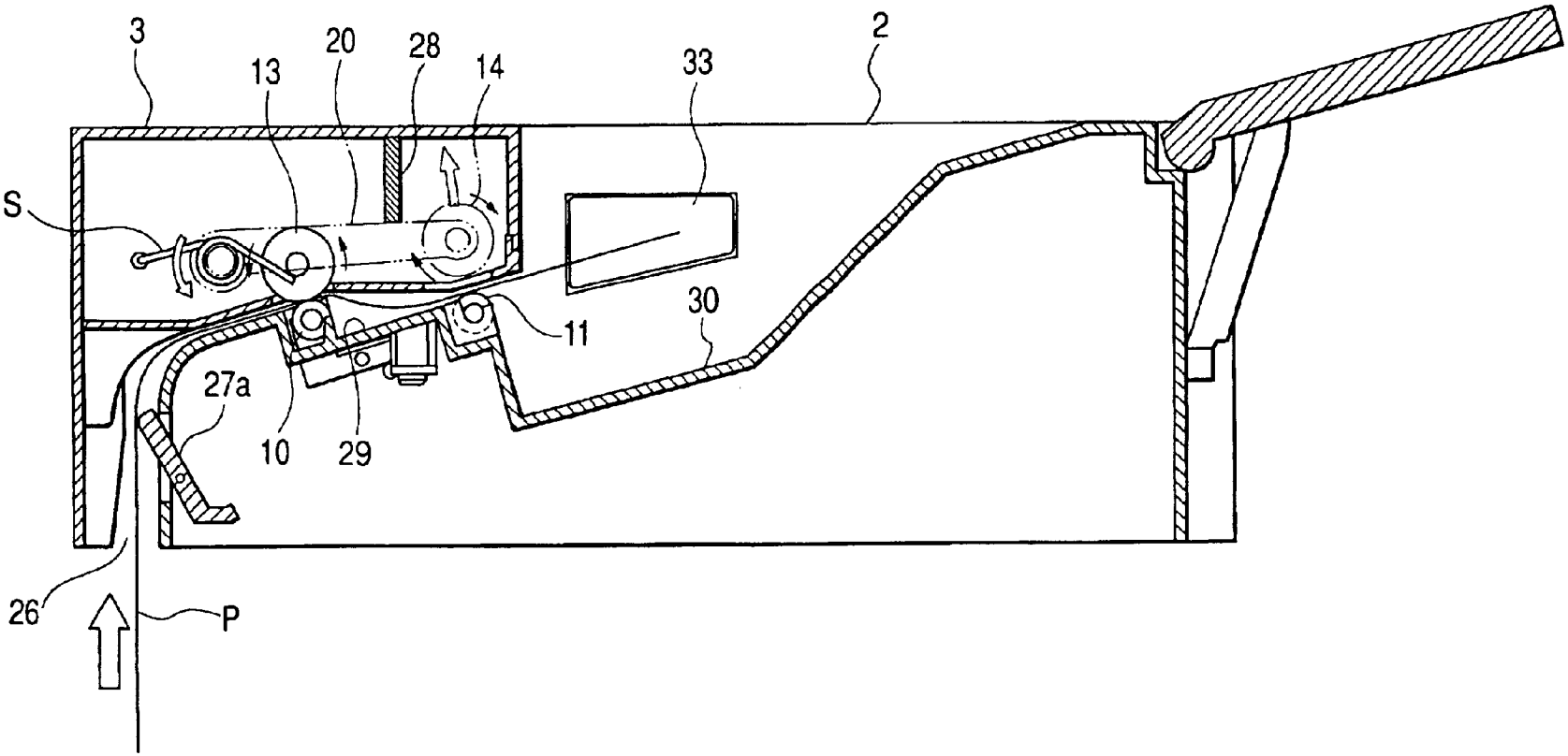
FIG. 9 is a sectional view showing the operation of the paper lead-in mechanism.

FIG. 5 shows a paper lead-in roller mechanism and a paper discharge roller mechanism, and the gear 4 for paper discharge to be driven through a reduction gear train from the paper feeding motor 16 is engaged with the gear 7 provided on the cover 3 side. The gear 7 is attached to a shaft 19 through a torque limiter 18 of a friction clutch type or the like, and a shaft 14*a* of the paper discharge roller 14 is rotatably attached to the tip of a link arm 20 extended rearward from both ends of the shaft 19. An intermediate gear 21 attached to the middle of the link arm 20 is engaged with the gear 7, and a gear pulley 22 provided coaxially with the intermediate gear 21 and a gear pulley 23 provided coaxially with the paper discharge roller 14 are coupled to each other through a timing belt 24. Moreover, the gear 5 for paper lead-in on the main case 2 side (which is hidden behind the gear for paper discharge in FIG. 5) is engaged with the gear 8 on the end of the paper lead-in roller 13. As shown in FIG. 9, a torsion coil spring S is attached to the link arm 20 and the link arm 20 is energized in such a direction that the paper discharge roller 14 on the tip separates from the driven roller 11 for paper discharge.

Figure 6:
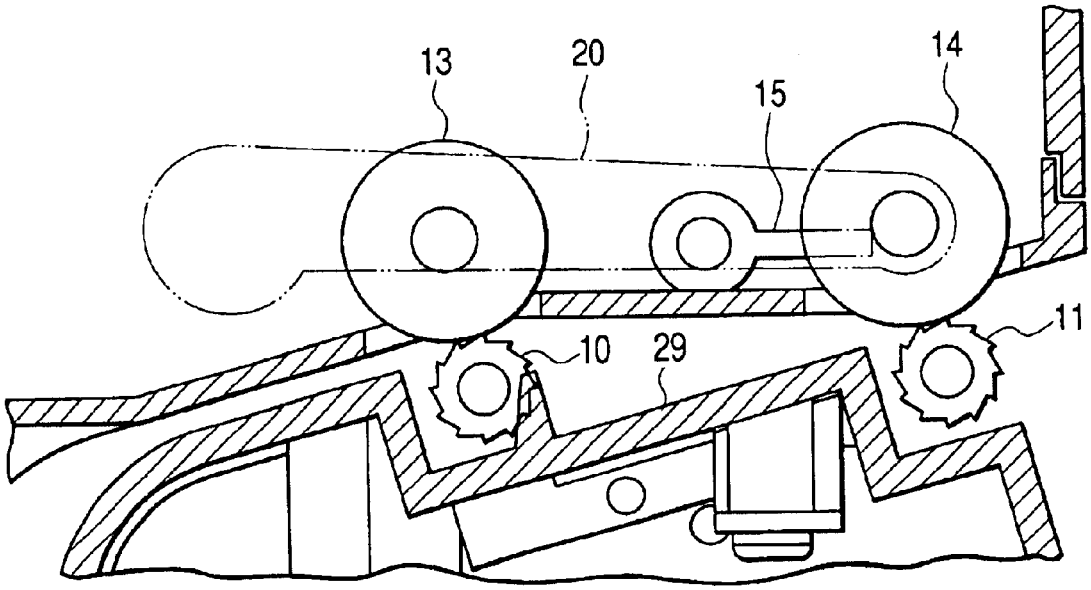
FIG. 6 is a sectional view showing the paper lead-in mechanism and the paper discharge mechanism.

FIG. 6 shows a paper feeding mechanism for a document binding apparatus according to the invention, in which the paper lead-in driven roller 10 provided in contact with the paper lead-in roller 13 and the paper discharge driven roller 11 provided in contact with the paper discharge roller 14 have the sectional shapes of a gear. In a state that the cover 3 is closed, the paper lead-in roller 13 and the paper lead-in driven roller 10 always come in contact with each other. As will be described below, the paper discharge roller 14 is brought down from a standby position set above the paper discharge driven roller 11 and comes in contact with the paper discharge driven roller 11 during the paper discharge.

Figure 7:
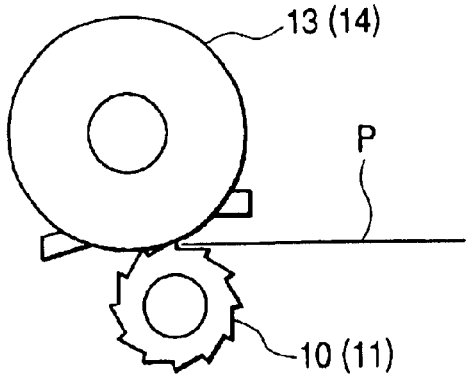
FIG. 7 is an explanatory view showing the actions of a paper lead-in driven roller and a paper discharge driven roller.

The paper lead-in driven roller 10 and the paper discharge driven roller 11 have the sectional shapes of a gear. During paper lead-in and paper discharge as shown in FIG. 7, therefore, the termination of a paper P is caught on the teeth of the driven roller 10 or 11 and is further pushed in a feeding direction when the paper gets out of a pair of upper and lower rollers 10 and 13 or 11 and 14. Therefore, the paper can be reliably discharged from a pair of rollers. It is desirable that the paper lead-in roller 13 and the paper discharge roller 14 should be formed of a high frictional material such as synthetic rubber and the paper lead-in driven roller 10 and the paper discharge driven roller 11 should be made of a low frictional polymeric resin such as polyethylene or polyacetal in order to maintain the rectilinearity of the paper and to prevent paper sticking.

Figure 8:
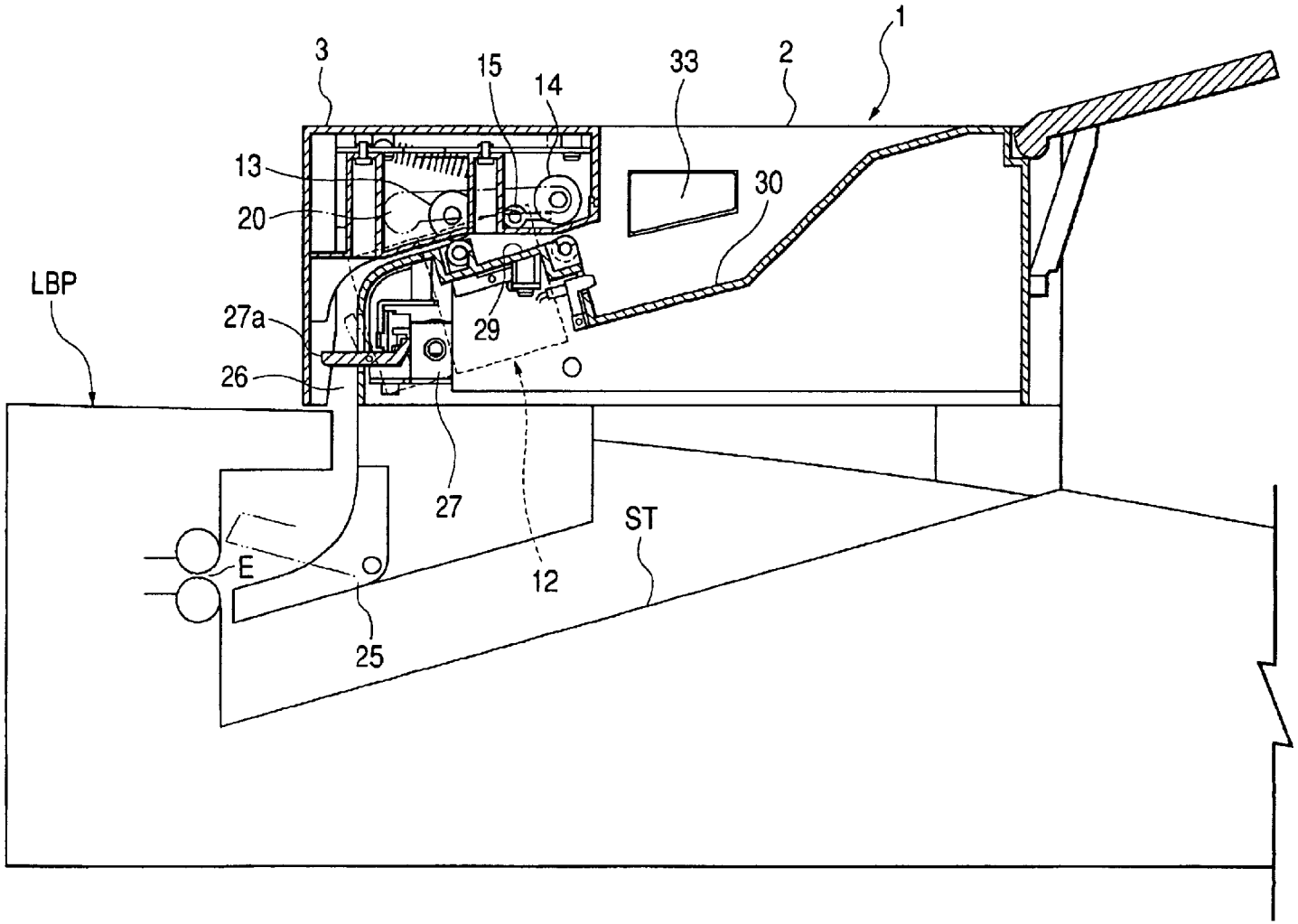
FIG. 8 is a sectional view showing the document binding apparatus.

Next, description will be given to the operations of the paper lead-in roller mechanism and the paper discharge roller mechanism. In FIG. 8 and the subsequent drawings, the sectional shapes of the paper lead-in driven roller 10 and the paper discharge driven roller 11 which are gear-shaped are simplified to have circular sections.

In FIG. 8, the document binding apparatus 1 is set onto a stack tray ST of the laser beam printer LBP and a paper guide 25 protruded downward from a lower face in the rear portion of the document binding apparatus 1 is opposed to a paper discharge port E of the laser beam printer LBP. A paper discharged from the paper discharge port E advances upward along the paper guide 25 and enters a guide slot 26 on the lower surface of the document binding apparatus 1 so that a lever 27*a* of a paper detecting sensor 27 is pushed, resulting in the start of the document binding apparatus 1.

As shown in FIG. 9, when an ON signal of the paper detecting sensor 27 is input, the paper feeding motor 16 is normally driven so that the paper lead-in roller 13 is rotated in a forward direction (a paper lead-in direction) through the gear 5 for paper lead-in and the link arm 20 is rotated in an upward direction through the gear 4 for paper discharge so that the paper discharge roller 14 is raised to such a position as not to come in contact with the driven roller 11 for paper discharge in a lower portion. Also after the link arm 20 hits on an upper stopper 28 and is thereby stopped, the gear 4 for paper discharge is continuously rotated by the slip of the torque limiter 18 shown in FIG. 5 and the paper discharge roller 14 is reversely rotated through the intermediate gear 21 and the timing belt 24.

When the tip of a paper P discharged from the laser beam printer reaches a portion between the paper lead-in roller 13 and the driven roller 10 for paper lead-in, the paper P is interposed between the two rollers 13 and 10 and is thus led into the document binding apparatus 1, and the termination portion of the paper P is dropped onto a binding table 29 of the document binding apparatus 1 when the paper P passes through the two rollers 13 and 10. After printing is completed, paper arrangement is carried out by means of the paper arranging mechanism and a binding process is carried out by means of the electromotive stapler 12 as will be described below and the paper feeding motor 16 is then driven reversely.

Figure 10:
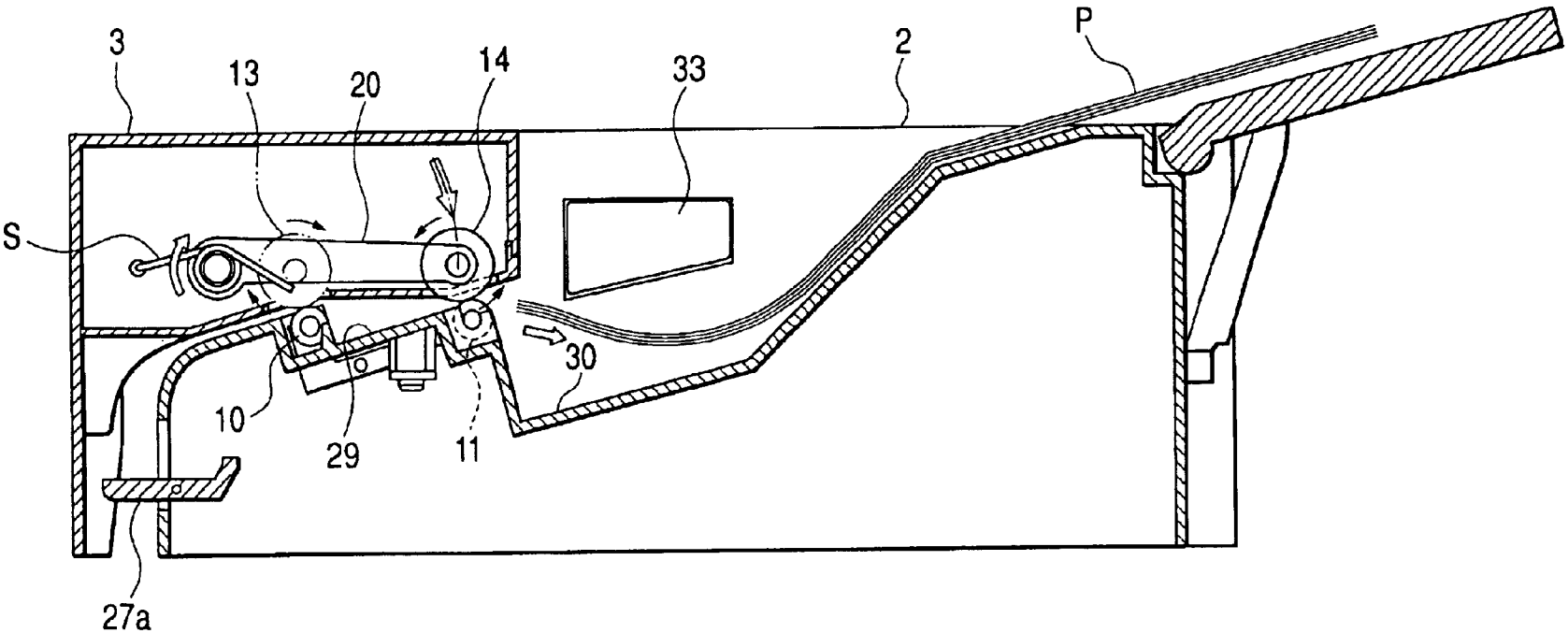
FIG. 10 is a sectional view showing the operation of the paper discharge mechanism.

As shown in FIG. 10, when the paper feeding motor 16 is reversely rotated, the link arm 20 is rotated in a downward direction against the torsion coil spring S and the bound paper P is interposed between the paper discharge roller 14 and the driven roller 11 for paper discharge, and the paper discharge roller 14 is normally rotated to feed the paper P forward so that the paper P is dropped from the binding table 29 onto a stack tray 30.

Figure 11:
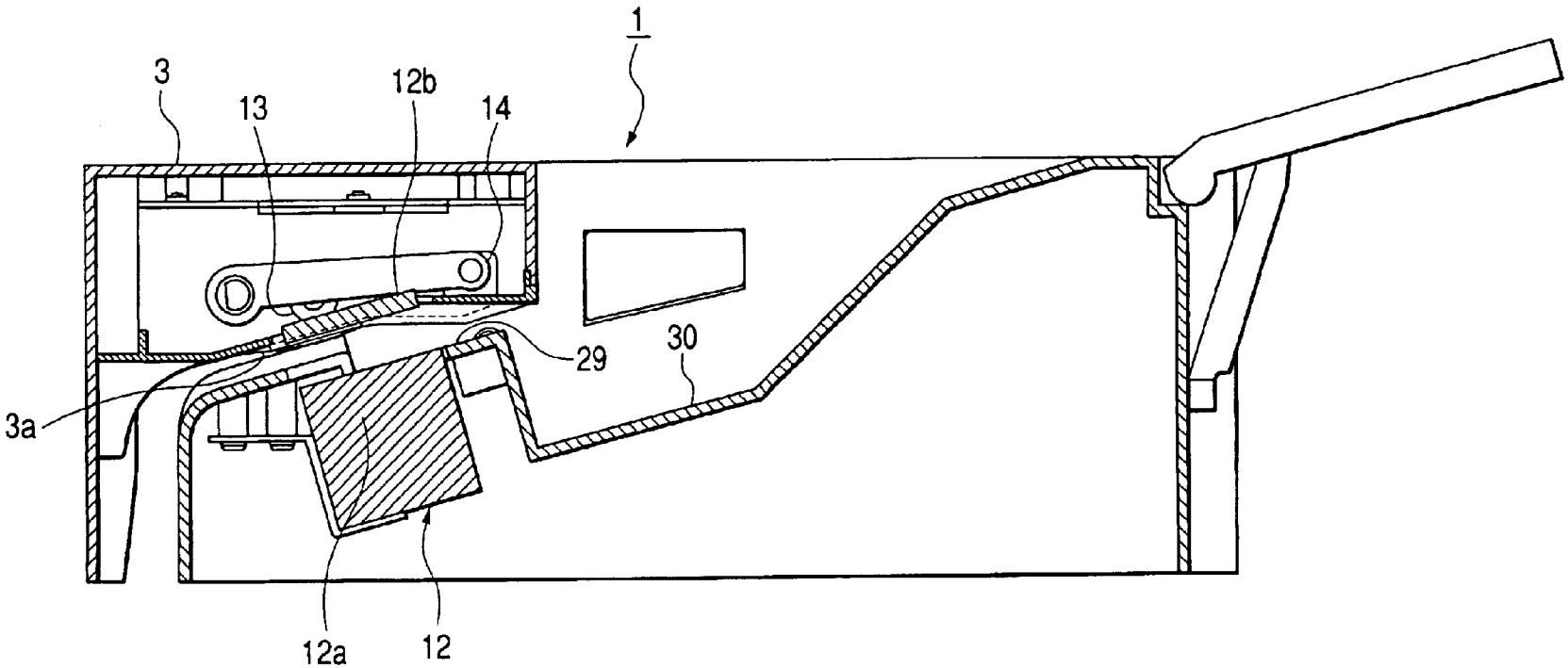
FIG. 11 is a sectional view showing the positional relationship between an electromotive stapler and a paper guide.
Figure 12:
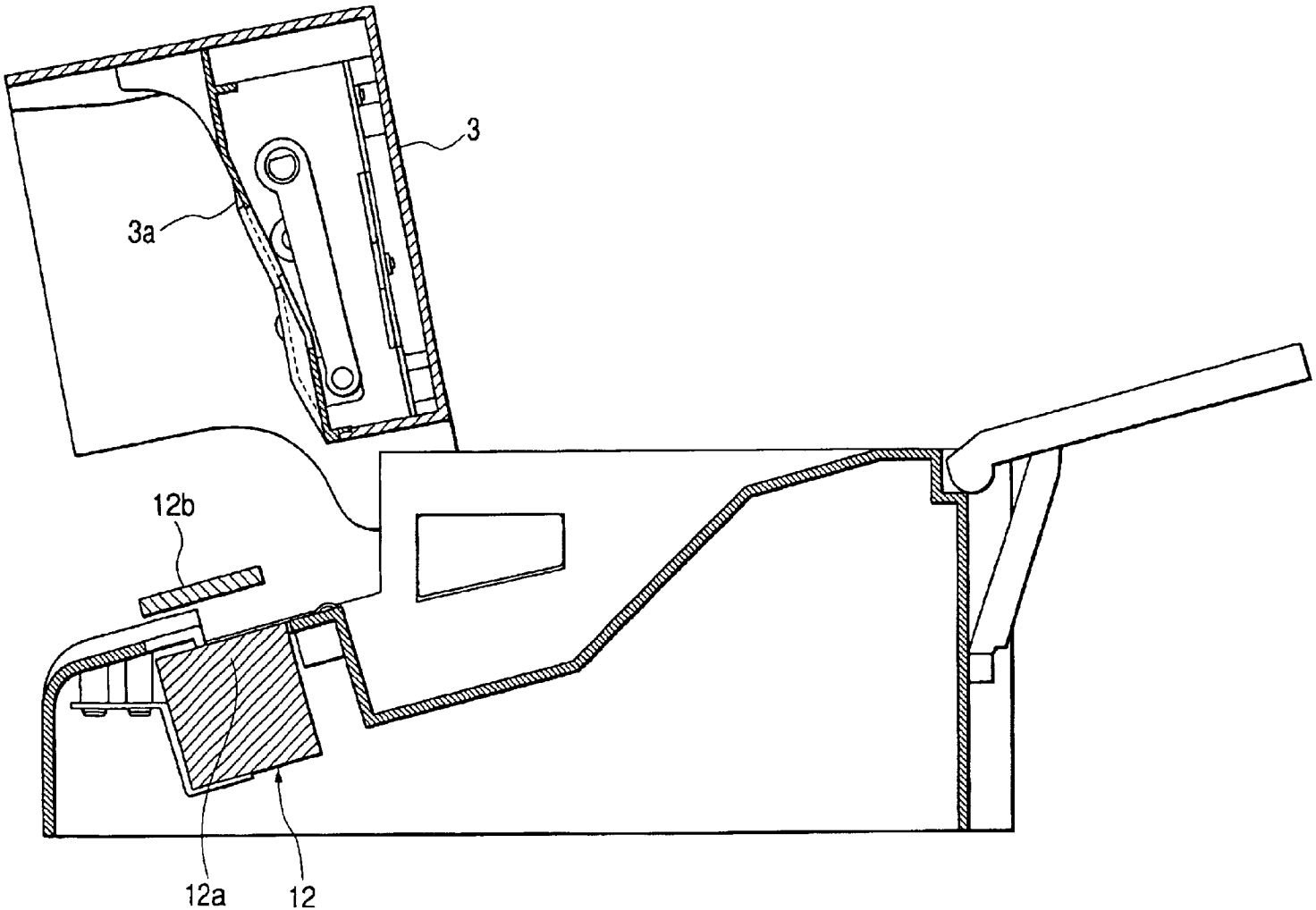
FIG. 12 is a sectional view showing a state in which the cover is opened.

FIGS. 11 and 12 show the positional relationship between the electromotive stapler 12 and the paper guide 3*a*, and the base of the electromotive stapler 12 and the upper surface of a driver section 12*a* are almost on the level with the surface of the binding table 29, and a clincher section 12*b* positioned above the driver section 12*a* is opposed to the driver section 12*a*. As shown in FIG. 11, the paper guide 3*a* formed on the back face of the cover 3 is positioned immediately before the clincher section 12*b* in a paper transfer direction, and an apex of the paper guide 3*a* which is protruded downward from the back face of the cover 3 is set in a lower position than the clincher section 12*b*. Accordingly, the corner portion of the tip of the paper led in through the guide slot 26 of the main frame 2 is guided toward the underside of the clincher section 12*b* along the surface of the paper guide 3*a*. Therefore, the corner portion of the tip of the paper can be prevented from hitting on the side surface of the clincher section 12*b* and being thus bent or a paper jam can be prevented from being caused. Consequently, the paper can reliably pass through a portion between the clincher section 12*b* and the driver section 12*a*.

Figure 13:
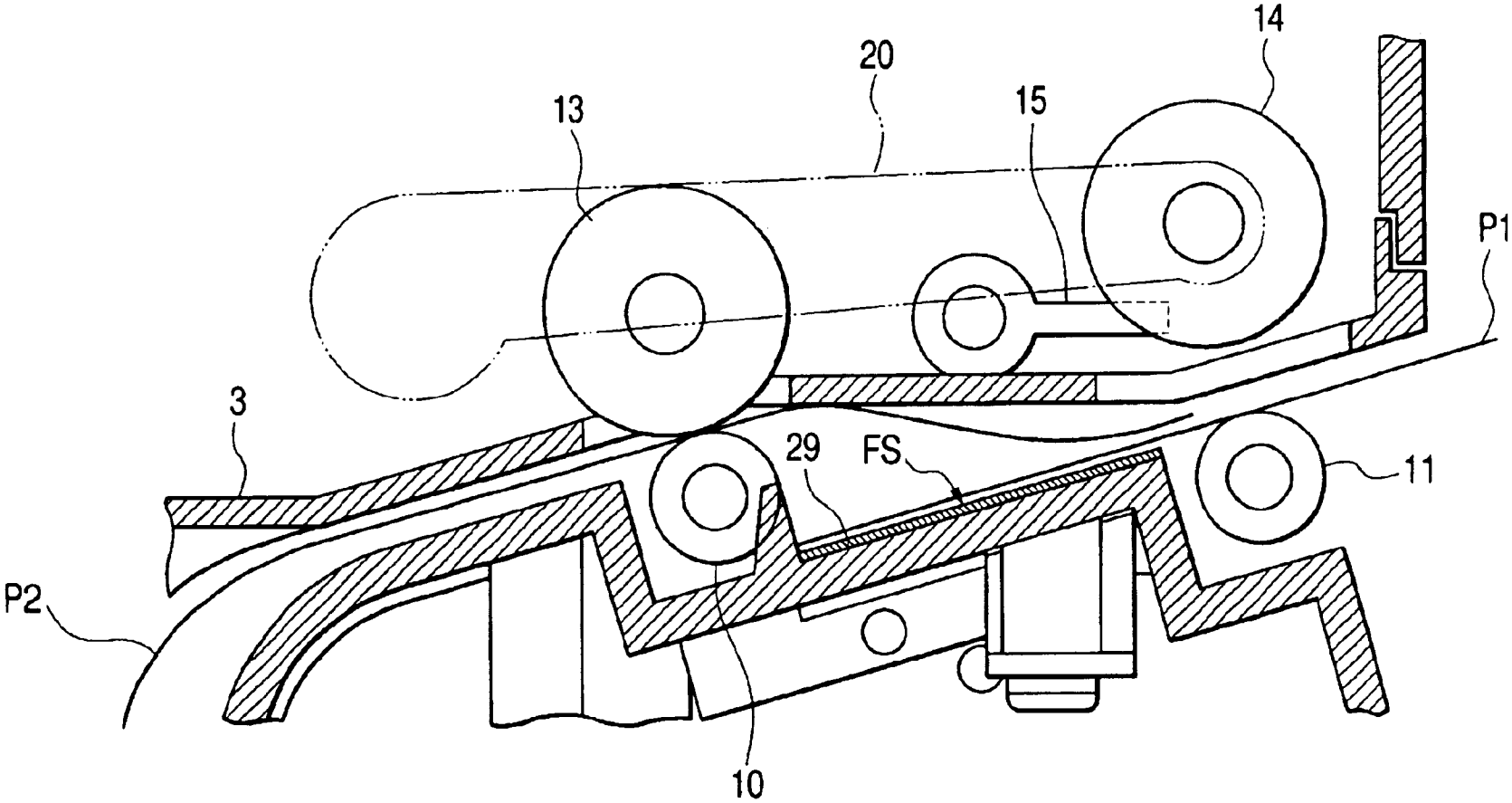
FIG. 13 is an enlarged sectional view showing a binding table portion having non-slip means.

FIG. 13 shows the details of the binding table 29, in which a non-slip sheet FS (for example, a sheet formed of rubber such as butyl rubber or polybutadiene rubber or another polymeric visco-elastic material) having a high coefficient of friction is stuck onto the surface of the binding table 29. Alternatively, a sheet having a sand paper-like surface or a carpet-shaped sheet meshed opposite to such a direction that the paper is easily shifted may be stuck, or a substance having a high coefficient of friction may be coated over the surface of the binding table 29, and furthermore, a non-slip processing such as mat finishing may be carried out over the surface of the binding table 29.

Figure 14:
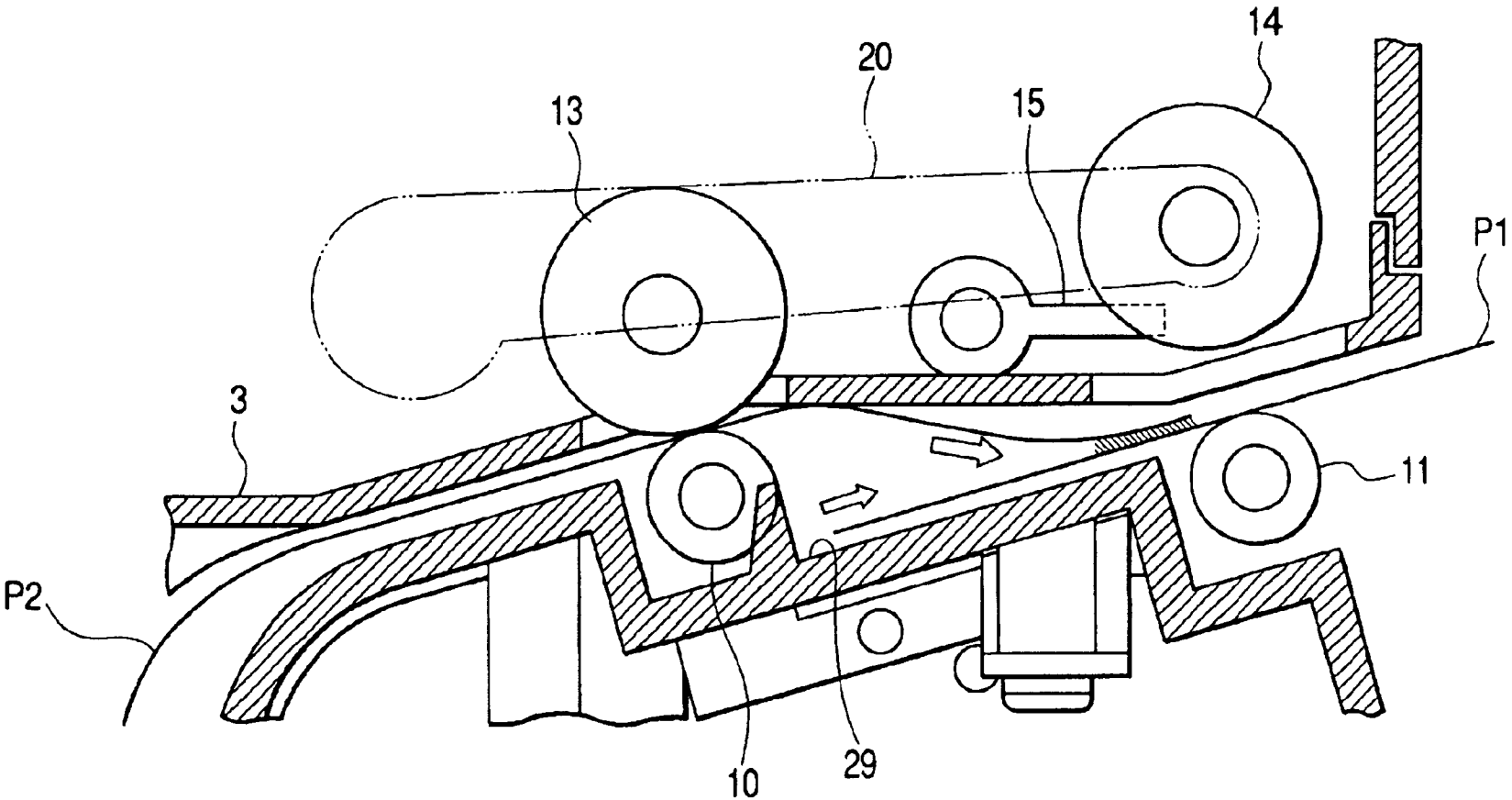
FIG. 14 is an enlarged sectional view showing the binding table portion having no non-slip means.

As described above, in the document binding apparatus to be externally attached to the printer apparatus, a whole height is to be reduced as much as possible, and an increase in the inclination angle of the binding table is restricted. In the case in which non-slip means is not provided on the binding table 29 having a small inclination angle as in the document binding apparatus 1, a coefficient of friction of the binding table 29 of the main case to be a plastic mold is low and a slip is easily caused. Therefore, a second paper P2 fed onto the binding table 29 pushes a first paper P1 put on the binding table forward so that the position of the first paper P1 is shifted in some cases as shown in FIG. 14.

On the other hand, in the case in which the non-slip sheet FS is provided on the surface of the binding table 29 as shown in FIG. 13, there is no possibility that the position of the first paper P1 might be shifted because the frictional force of the paper and the non-slip sheet FS is greater than that of the papers even if the second paper P2 fed onto the binding table 29 rubs the first paper P1 put on the binding table.

Figure 15:
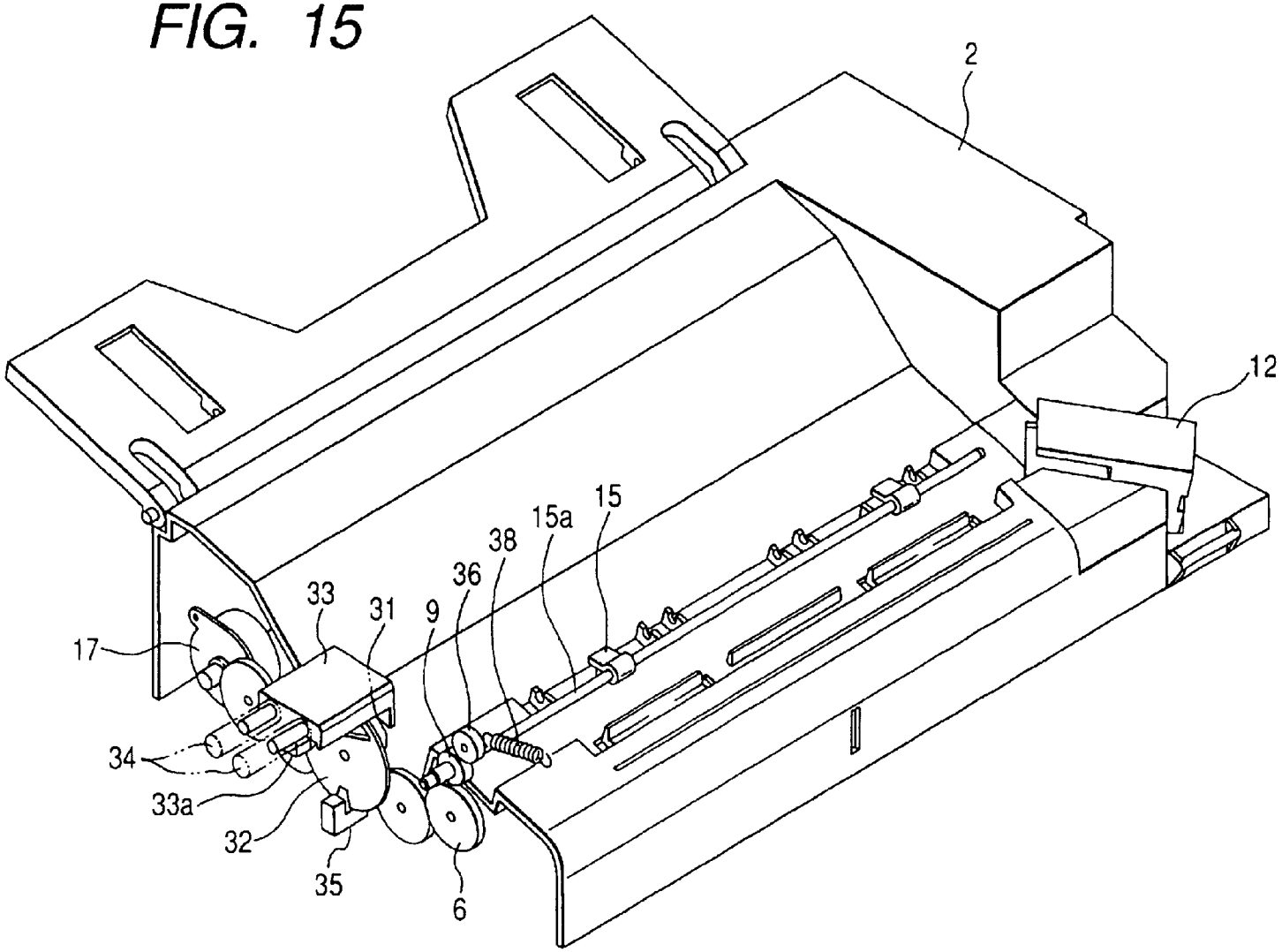
FIG. 15 is a perspective view showing a paper arranging mechanism.

FIG. 15 shows the paper arranging mechanism in which a cylindrical cam 32 is attached to the shaft of an intermediate gear 31 in the reduction gear train reaching the gear 6 for paper arrangement through the paper arranging motor 17. A paper arranging pusher 33 is attached to the frame of the document binding apparatus 1 and is energized in a central direction (a right direction) through a compression coil spring 34 so that a leg portion 33*a* on a lower surface elastically comes in contact with the cylindrical cam 32. The initial rotation position (standby position) of the cylindrical cam 32 is controlled by the detection signal of a photosensor 35.

Figure 16:
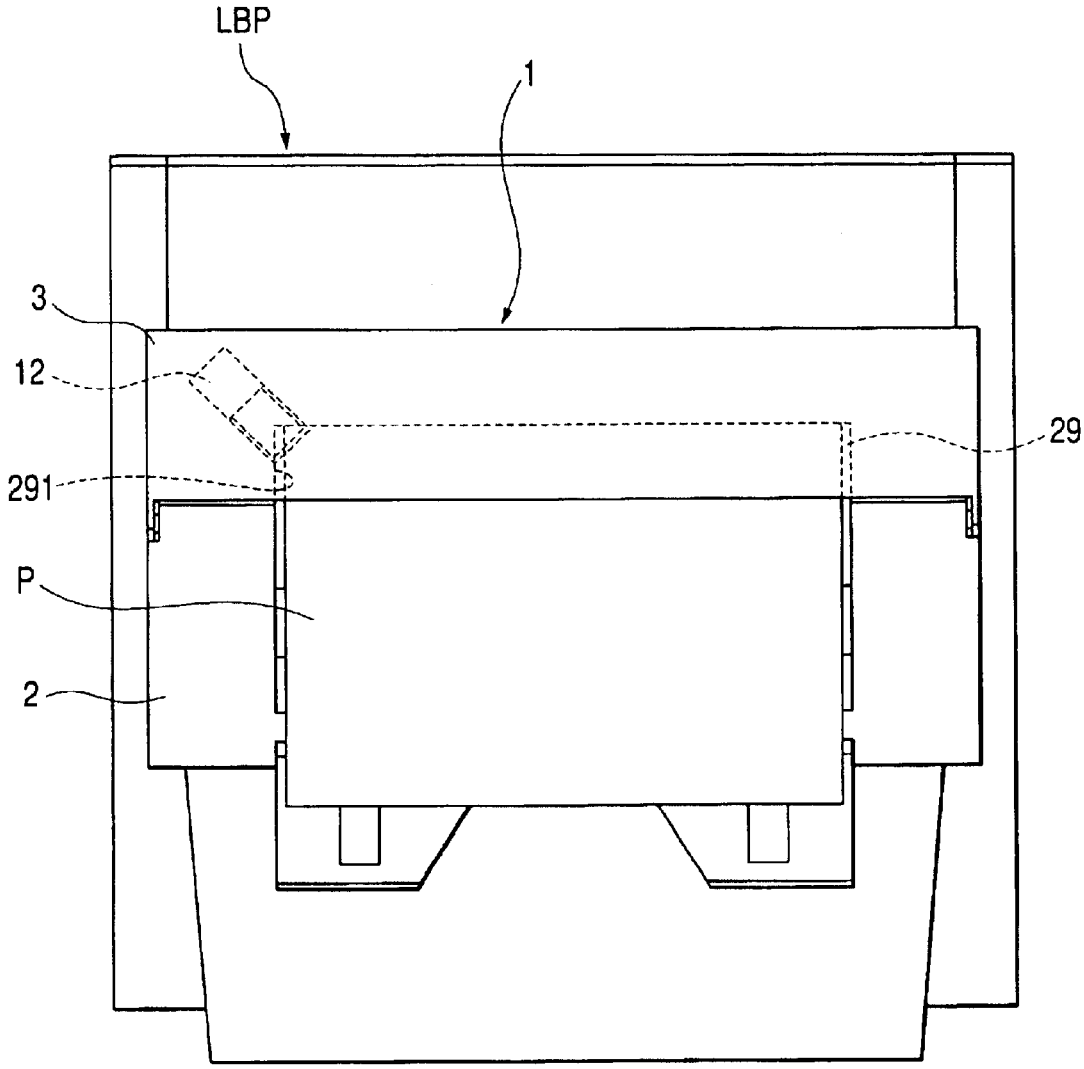
FIG. 16 is a plan view showing the document binding apparatus.
Figure 17:
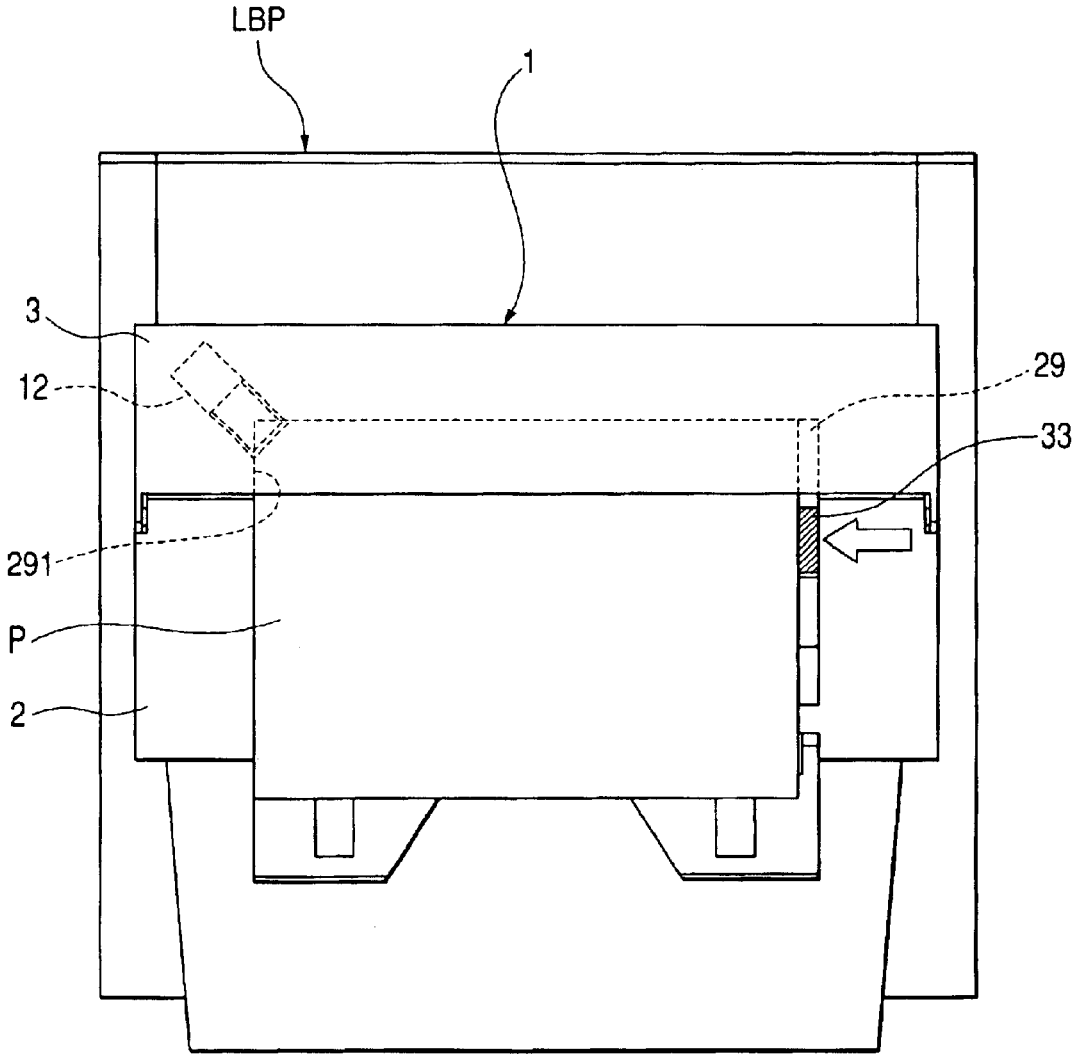
FIG. 17 is a plan view showing the document binding apparatus, illustrating the operation of a paper arranging pusher.

In a standby state shown in FIG. 15, the paper arranging pusher 33 is pressed down in an outer direction through the cylindrical cam 32 and is reciprocated to move forward in the central direction and to move backward in the outer direction when the cylindrical cam 32 is rotated once, and pushes the paper P fed onto the binding table 29 as shown in FIG. 16 against a left side wall 291 of the binding table 29 as shown in FIG. 17, thereby carrying out alignment in a transverse direction every time the paper P is fed into the binding table 29.

Figure 18:
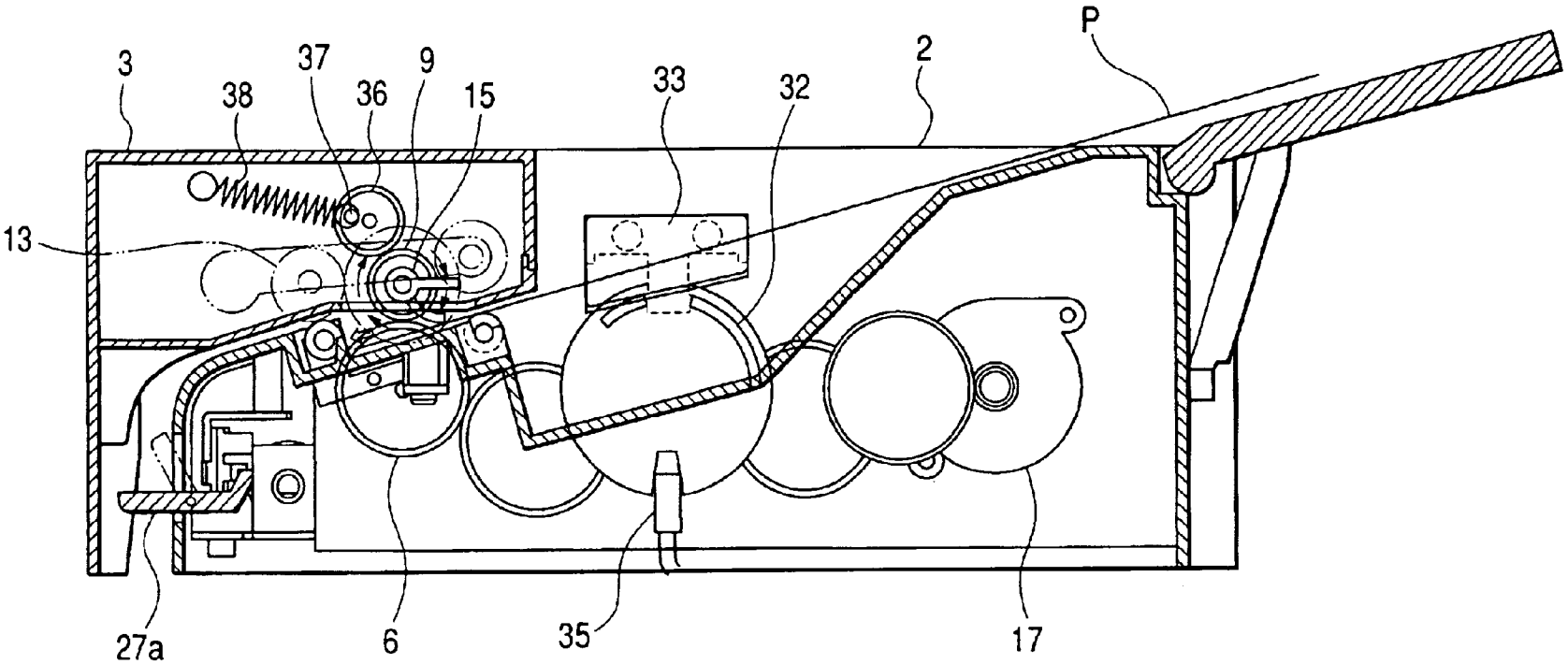
FIG. 18 is a sectional view showing the operation of a paper arranging rotation brush.

The gear 9 attached to the shaft 15*a* of the paper arranging rotation brush 15 in the cover 3 is engaged with the gear 6 for paper arrangement on the main case 2 side and is rotated in a reverse direction to the rotation direction of the paper lead-in roller 13 as shown in FIG. 18, and the paper arranging rotation brush 15 formed of rubber sweeps the surface of the paper P fed onto the binding table 29 and pushes the paper P against a wall surface in the rear part of the binding table 29 and arranges the position of the paper P in a longitudinal direction.

Then, the electromotive stapler 12 is driven to bind the paper after the paper arranging process and the paper feeding motor 16 is inverted from normal rotation to reverse rotation as described above, and the paper P is interposed between the paper discharge roller 14 and the driven roller 11 for paper discharge after the staple process and is thus fed from the binding table 29 onto the stack tray 30 as shown in FIG. 10.

As shown in FIGS. 15 and 18, an idler gear 36 is engaged with the gear 9 provided on the shaft 15*a* of the paper arranging rotation brush 15 provided on the cover 3 and a tension coil spring 38 is provided on a crank pin 37 formed on the side surface of the idler gear 36 and one point of the cover 3. The paper arranging pusher 33 and the paper arranging rotation brush 15 are linked through a series of driving gear trains and both of them are cooperatively operated so that the paper arrangement is carried out.

The idler gear 36 is rotated interlockingly with the paper arranging rotation brush 15 and the tension coil spring 38 expands and contracts with the rotation of the crank pin 37. A state that the tip of the paper arranging rotation brush 15 is turned forward as shown is set to be an initial rotation position (a standby position), and the paper arranging rotation brush 15 is rotated once for each cycle of the paper arranging operation. The rotation position of the crank pin 37 is set in such a position that the tension coil spring 38 contracts most greatly when the paper arranging rotation brush 15 is set in the initial rotation position.

Figure 19:
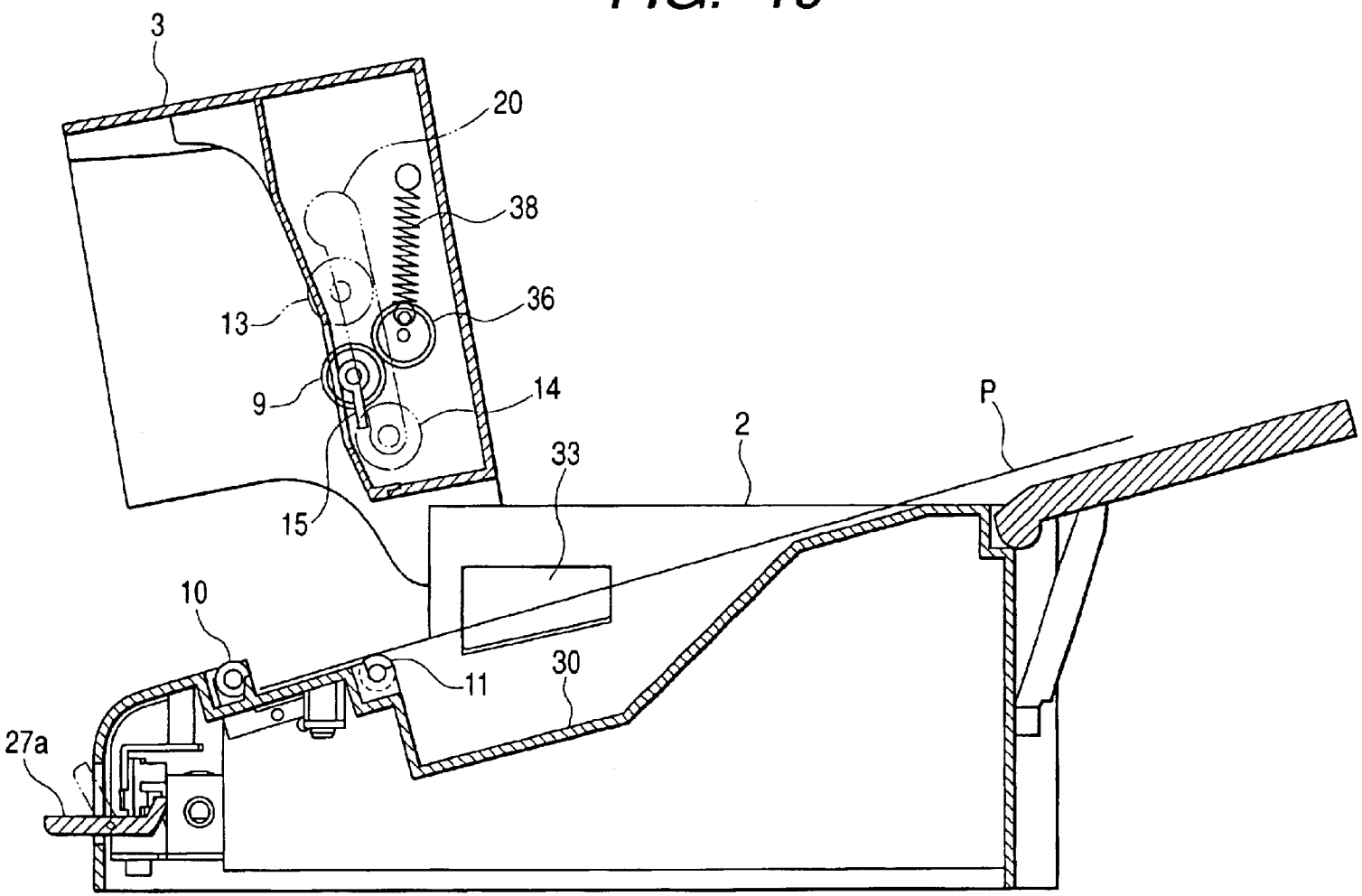
FIG. 19 is a sectional view showing a state that the cover is opened.

When a paper jam is caused, the cover 3 is opened to remove the jammed paper. If the gear 9 of the shaft 15*a* of the paper arranging rotation brush 15 separates from the gear 6 for paper arrangement on the main case 2 side when the cover 3 is opened as shown in FIG. 19, the idler gear 36 and the paper arranging rotation brush 15 are returned to the initial rotation position by the tensile force of the tension coil spring 38. Consequently, when the cover 3 is closed, the paper arranging rotation brush 15 is set in the initial rotation position and a document binding work can be thus restarted.

Figure 20:
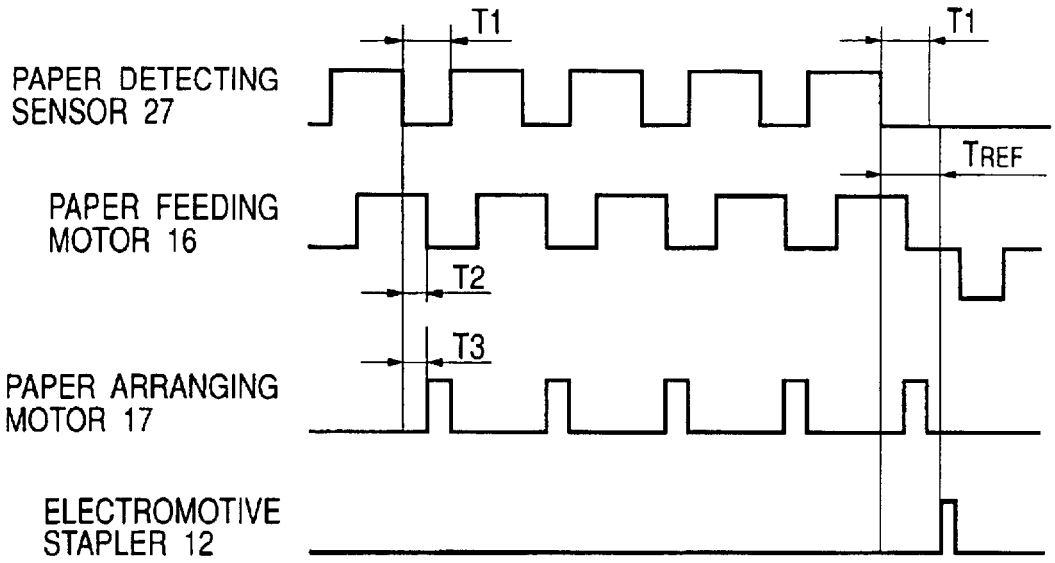
FIG. 20 is a timing chart representing the operation of the document binding apparatus.

Next, description will be given to the operation cycle of the document binding apparatus 1 in accordance with a timing chart of FIG. 20. FIG. 20 shows the operations of the paper detecting sensor 27, the paper feeding motor 16, the paper arranging motor 17 and the electromotive stapler 12. The output signal of the paper detecting sensor 27 is ON until one paper discharged from the LBP reaches the paper detecting sensor 27 and then passes therethrough and an ON signal indicative of the number of times corresponding to the number of the papers is output.

When the ON signal of the paper detecting sensor 27 is input to a control section in the standby state, the control section outputs a normal rotation signal to the paper feeding motor driving circuit to start the paper feeding motor 16 and the paper discharged from the printer apparatus is fed to the binding table 29. The output signal of the paper detecting sensor 27 is turned OFF when the paper passes through the paper detecting sensor 27, and the control section outputs a normal rotation signal to the paper arranging motor driving circuit after a certain time T3 since the output signal is turned OFF and the paper arranging motor 17 is started to arrange the paper put on the binding table 29.

While the paper feeding motor 16 is stopped after a certain time T2 since the output signal of the paper detecting sensor 27 is turned OFF, a next paper is discharged from the printer apparatus and the output of the paper detecting sensor 27 is turned ON, and the paper feeding motor 16 is then started again to lead in the paper. Thus, the above paper lead-in operation and paper arranging operation are repeated.

When the printing is completed so that the output signal of the paper detecting sensor 27 is turned OFF and the OFF state continues for a reference time $T_{REF}$ (a reference time set to be longer than a time gap T1 during the paper discharge of the printer apparatus) or more, a driving signal is output to the electromotive stapler driving circuit and the paper put on the binding table 29 is bound through the electromotive stapler 12. Subsequently, the electromotive stapler 12 is stopped and the paper feeding motor 16 is then driven reversely to discharge the paper put on the binding table 29 to the stack tray 30, thereby completing an operation for one cycle. The reference time $T_{REF}$ can be changed according to a printing process speed (ppm) of the printer apparatus.

Figure 21:
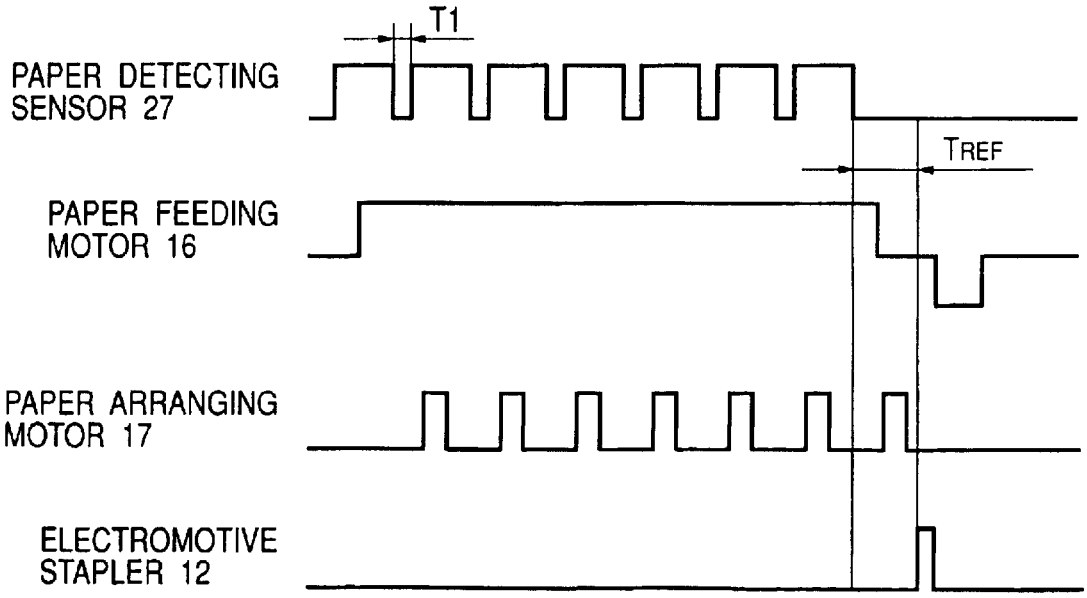
FIG. 21 is a timing chart representing the operation of the document binding apparatus.

FIG. 21 shows the case in which the printing process speed of the printer apparatus is high and the time gap T1 taken till the discharge of the next paper after the paper discharge is shorter than a time T2 in FIG. 20 (a time taken until the output signal of the paper detecting sensor is turned OFF and the paper feeding motor 16 is then stopped) (T1<T2). In this case, although the paper feeding motor 16 continues the normal rotation until a first paper turns ON the paper detecting sensor 27 and a last paper is completely led in, the paper arranging motor 17 is started to execute the paper arrangement every time the paper detecting sensor 27 is turned OFF in a gap provided while the printer apparatus discharges the papers one by one. In the same as in the case of FIG. 20, the printing is completed and the paper detecting sensor 27 is then turned OFF, and a staple process is carried out by the electromotive stapler 12 and a paper discharging process is carried out by the reverse rotation of the paper feeding motor 16 after an OFF time exceeds the reference time $T_{REF}$.

Figure 22:
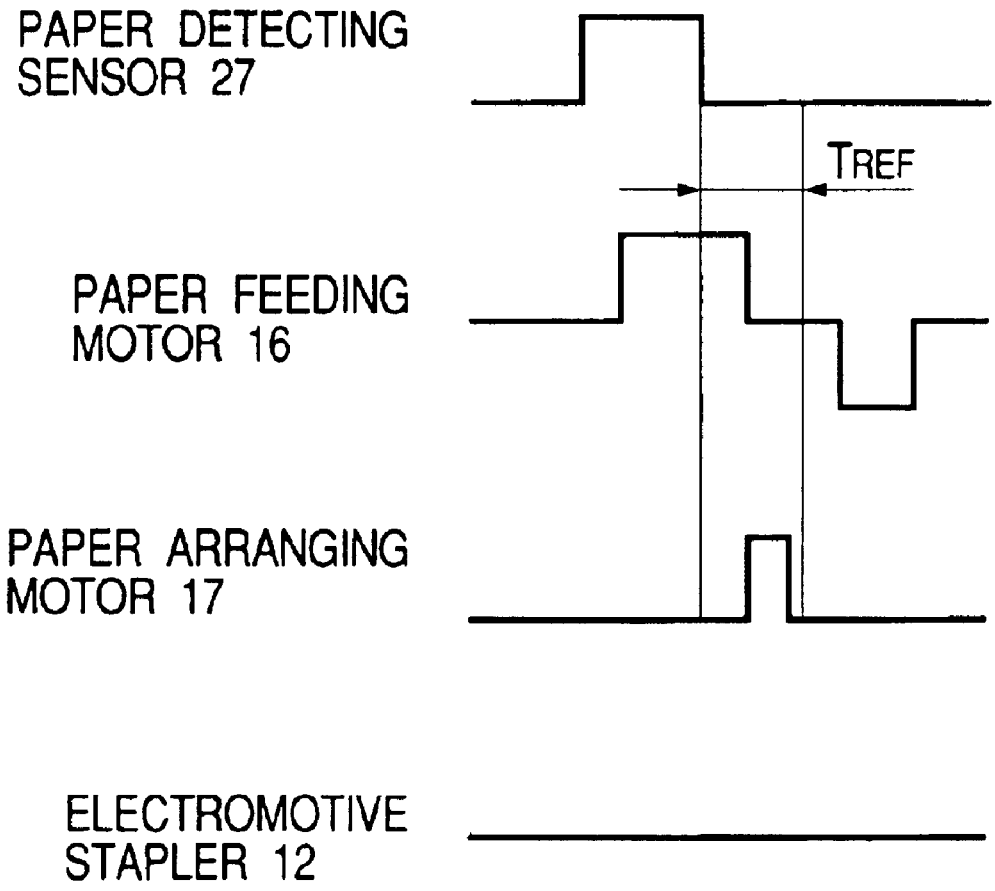
FIG. 22 is a timing chart representing the operation of the document binding apparatus.

FIG. 22 shows the case in which the number of papers to be printed is one sheet. One sheet of paper is led into the binding table 29 and the paper arranging motor 16 is started to arrange the paper put on the binding table 29. In the case in which the count number of the ON signal of the paper detecting sensor 27 is less than two, a driving signal is not output to the electromotive stapler 12 even if the time taken after the paper detecting sensor 27 is turned OFF passes the reference time $T_{REF}$, and the paper feeding motor 16 is driven reversely to discharge the paper from the binding table 29 to the stack tray 30.

Moreover, data on the number of papers to be printed in the printer apparatus may be directly input to the control circuit through a connection cable or the like instead of the paper detection, and may carry out a staple process by means of the electromotive stapler and a paper discharging process through the reverse rotation of the paper feeding motor upon receipt of the fact that the number of papers to be printed is reached.

It is a matter of course that the invention is not restricted to the embodiment described above but the invention can be variously changed within a technical range thereof and includes alterations.

As described above, since the document binding apparatus according to the invention is externally attached to a printer apparatus such as a page printer and a paper discharged from the printer apparatus is arranged and bound through a staple, thereby automatically executing a binding process, it can contribute to an enhancement in a business processing efficiency.

Moreover, the document binding apparatus provided with the sensor for detecting a paper discharged from the printer apparatus and constituted to execute a series of binding processes in response to the ON signal of the paper detecting sensor carries out a self-operation irrespective of the control system of the printer apparatus and a communication between the printer apparatus and a control signal does not need to be performed. Therefore, connecting conditions are not restricted but a versatility is increased.

Further, the paper feeding mechanism of the document binding apparatus according to the invention is constituted such that the paper lead-in roller and the paper discharge roller are driven by one motor to switch the paper lead-in operation and the paper discharge operation depending on the direction of rotation of the motor. Consequently, the occupied space of the mechanism section is decreased to produce an effect that the size and weight of the document binding apparatus can be reduced.

Moreover, in the paper feeding mechanism of the document binding apparatus according to the invention, the paper lead-in driven roller provided in contact with the paper lead-in roller and the paper discharge driven roller provided in contact with the paper discharge roller have the gear-shaped sections. Therefore, when the paper gets out of a pair of upper and lower rollers during the paper lead-in and the paper discharge, the teeth of the driven roller are caught on the termination of the paper to further push the paper in the feeding direction. Consequently, the paper can be reliably discharged from the pair of rollers and the stability of the paper feed can be enhanced.

Further, the paper arranging mechanism of the document binding apparatus according to the invention has such a structure that the paper arranging pusher for transversely pushing a longitudinal side of a paper put on the binding table to arrange a position in a transverse direction and the paper arranging rotation brush for sweeping the surface of the paper in the longitudinal feeding direction to arrange a position in a longitudinal direction are driven by means of one motor. Therefore, the occupied space of the mechanism section can be decreased and it is possible to obtain an effect that the size and weight of the document binding apparatus can be reduced.

Moreover, the initial rotation position returning means using a spring is provided on the paper arranging rotation brush disposed on the cover. Therefore, when the cover is closed, the paper arranging rotation brush is automatically set into the initial rotation position, and the possibility that the lead-in operation of the paper might be hindered can be eliminated.

Further, the document binding apparatus according to the invention has such a structure that the electromotive stapler for binding a document is fixed and the side edge portion of the paper passes through the portion between the clincher section and the diver section of the electromotive stapler during the paper lead-in. Therefore, it is not necessary to provide means for moving the electromotive stapler toward the paper arranged on the binding table as in a conventional structure and means for inserting the led paper into the portion between the clincher section and the driver section of the electromotive stapler. Thus, the mechanism can be simplified and the size thereof can be reduced.

Moreover, the paper led from the printer apparatus is guided to the portion between the clincher and the driver of the electromotive stapler by means of the paper guide provided on the back face of the cover. Therefore, it is possible to prevent the corner portion of the tip of the paper from hitting on the side surface of the electromotive stapler and being thus bent or to prevent a paper jam from being caused. Thus, a stable operation can be expected.

Further, in the binding table of the document binding apparatus according to the invention, the non-slip member having a high coefficient of friction, for example, a rubber sheet is stuck onto the surface thereof. Therefore, even if the inclination angle of the binding table is set to be small, the paper put on the binding table is not shifted by the friction of the paper led into the binding table, and a reduction in the height of the document binding apparatus and the stability of alignment of the paper are compatible with each other.

Moreover, in the document binding apparatus according to the invention, the paper lead-in roller, the paper discharge roller and the paper arranging rotation brush are provided on the openable cover, and the paper feeding path is exposed if the cover is opened. Therefore, the paper put on the paper feeding path can easily be removed during a paper jamming accident and the roller can also be inspected and cleaned readily.

What is claimed is:

1. A document binding apparatus for externally attaching to a printer apparatus, comprising:

a paper lead-in roller mechanism for leading a paper discharged from the printer apparatus;

a paper arranging mechanism for aligning a position of the paper;

a paper binding mechanism for binding the paper;

a paper discharge roller mechanism for discharging the paper further comprising a binding table receiving the paper discharged from the printer apparatus;

wherein a surface of said binding table is provided with non-slip treatment preventing misalignment of the arranged paper.

2. The document binding apparatus according to claim 1, wherein said paper binding mechanism is a an electromotive stapler including a clincher and a driver and fixed into such a position that a staple hits on a corner portion of the paper put on said binding table, and wherein a side edge portion of the paper enters a portion between said clincher and said driver and runs during lead-in of the paper, and the corner portion of the paper accumulated on said binding table is bound by said electromotive stapler.

3. The document binding apparatus according to claim 1 wherein said paper binding mechanism binds a vicinity of a corner portion of the paper put on said binding table, and said paper discharge roller mechanism discharges the paper input on said binding table.

4. The document binding apparatus according to claim 1, wherein the non-slip treatment is a non-slip member having a high coefficient of friction relative to a coefficient of friction between the sheets of paper and provided by one of sticking and coating.

5. The document binding apparatus according to claim 4, wherein said non-slip member is a rubber sheet.

6. The document binding apparatus according to claim 1 wherein the non-slip treatment is a non-slip processing directly carried out over said surface of said binding table.

7. The document binding apparatus according to claim 1, wherein said paper binding mechanism is an electromotive stapler for binding a vicinity of a corner portion of the paper.

8. The document binding apparatus according to claim 1, further comprising:

a stack tray for receiving the paper discharged by said paper discharge roller mechanism.

9. The document binding apparatus according to claim 1, further comprising:

a control device for sequence controlling said paper lead-in roller mechanism, said paper arranging mechanism, an electromotive stapler and said paper discharge roller mechanism, wherein a series of operations are executed, in which the paper discharged from the printer apparatus is led and arranged, and the arranged paper is bound through a staple, and the bound paper is discharged.

10. The document binding apparatus according to claim 1, further comprising:

a paper detecting sensor for detecting the paper discharged from the printer apparatus;

a paper lead-in starter for starting said paper lead-in roller mechanism in response to an ON signal of said paper detecting sensor;

a paper arranging starter for starting said paper arranging mechanism in response to an OFF signal of said paper detecting sensor;

a comparator for comparing an OFF continuation time taken after said paper detecting sensor is turned OFF with a reference time;

a binding starter for starting said paper binding mechanism when the OFF continuation time exceeds the reference time; and a discharge starter for starting said paper discharge roller mechanism after binding by said paper binding mechanism.

11. The document binding apparatus according to claim 10, further comprising:

a counter for measuring the number of ON operations of said paper detecting sensor, wherein said binding starter starts said paper binding mechanism when the number of the ON operations of said paper detecting sensor is two or more.

12. The document binding apparatus according to claim 10, wherein said paper detecting sensor includes a lever.

13. The document binding apparatus according to claim 1, wherein said paper lead-in roller mechanism includes:

a paper lead-in roller; and a paper lead-in driven roller provided in contact with said paper lead-in roller and having a gear-shaped section.

14. The document binding apparatus according to claim 13, wherein said paper discharge roller mechanism includes:

a paper discharge roller; and a paper discharge driven roller provided in contact with said paper discharge roller and having a gear-shaped section.

15. The document binding apparatus according to claim 1, wherein said paper discharge roller mechanism includes:

a paper discharge roller; and a paper discharge driven roller provided in contact with said paper discharge roller and having a gear-shaped section.

16. A document binding apparatus for externally attaching to a printer apparatus, comprising:

a paper lead-in roller mechanism for leading a paper discharged from the printer apparatus;

a paper arranging mechanism for aligning a position of the paper;

a paper binding mechanism for binding the paper further comprising:

a paper detecting sensor for detecting the pager discharged from the printer apparatus;

a paper lead-in starter for starting said paper lead-in roller mechanism in response to an ON signal of said paper detecting sensor;

a paper arranging starter for starting said paper arranging mechanism in response to an OFF signal of said paper detecting sensor;

a comparator for comparing an OFF continuation time taken after said paper detecting sensor is turned OFF with a reference time;

a binding starter for starting said paper binding mechanism when the OFF continuation time exceeds the reference time; and a discharge starter for starting said paper discharge roller mechanism after binding by said paper binding mechanism; and a paper discharge roller mechanism for discharging the paper;

wherein said paper lead-in roller mechanism includes a paper lead-in roller, and said paper discharge roller mechanism includes a paper discharge roller, a paper discharge gear and a paper discharge driven roller, and said document binding apparatus further comprising:

a paper feeding motor;

a gear train for driving said paper lead-in roller and a paper discharge roller by said paper feeding motor;

a rotatable link arm including a shaft;

a torque limiter;

a gear attached to said shaft of said link arm through said torque limiter and engaged with said paper discharge gear; and a power transmitting member, wherein said paper discharge roller is attached to a tip portion of said link arm, and said paper discharge roller and said gear attached to said shaft of said link arm are coupled through said power transmitting member, and wherein, when said paper feeding motor is rotated in a forward direction, said paper lead-in roller is rotated in a forward direction to lead in a paper and a tip of said link arm is rotated in such a direction as to separate from a paper feeding path so that said paper discharge roller separates from said paper discharge driven roller, and wherein, when said paper feeding motor is rotated in a reverse direction, the tip of said link arm is rotated in a direction of the paper feeding path so that said paper discharge roller comes in contact with said paper discharge driven roller, and said paper discharge roller is rotated in a forward direction, thereby discharging the paper.

17. The document binding apparatus according to claim 16, wherein said power transmitting member is at least one of an intermediate gear or a timing belt.

18. The document binding apparatus according to claim 16, wherein said paper lead-in roller mechanism further includes a paper lead-in driven roller provided in contact with said paper lead-in roller and having a gear-shaped section.

19. The document binding apparatus according to claim 18, wherein said paper discharge driven roller of said paper discharge roller mechanism has a gear-shaped section.

20. The document binding apparatus according to claim 16, wherein said paper discharge driven roller of said paper discharge roller mechanism has a gear-shaped section.

21. A document binding apparatus for externally attaching to a printer apparatus, comprising:

a paper lead-in roller mechanism for leading a paper discharged from the printer apparatus;

a paper arranging mechanism for aligning a position of the paper;

a paper binding mechanism for binding the paper; and a paper discharge roller mechanism for discharging the paper, wherein said paper lead-in roller mechanism includes a paper lead-in roller and a paper lead-in gear, and said paper discharge roller mechanism includes a paper discharge roller and a paper discharge gear, and said document binding apparatus further comprising:

a paper arranging rotation brush;

a paper arrangement gear;

a main case provided with said paper lead-in gear, said paper discharge gear and said paper arrangement gear;

an openable cover assembled into said main case and provided with said paper lead-in roller, said paper discharge roller and said paper arranging rotation brush; and gear provided on respective shafts of said paper lead-in roller, said paper discharge roller and said paper arranging rotation brush, and respectively engaged with said paper lead-in gear, said paper discharge gear and said paper arrangement gear in order to transmit a power in a state that said cover is closed.

22. A document binding apparatus for externally attaching to a printer apparatus, comprising:

a paper lead-in roller mechanism for leading a paper discharged from the printer apparatus;

a paper arranging mechanism for aligning a position of the paper;

a paper binding mechanism for binding the paper;

a paper discharge roller mechanism for discharging the paper; and a binding table receiving the paper discharged from the printer apparatus;

wherein said binding table includes a right wall surface and a left wall surface, and wherein said paper arranging mechanism includes:

a paper arranging pusher formed to be protruded from one of said right wall surface and said left wall surface into said binding table and to be retreated therefrom;

a cam mechanism for reciprocating said paper arranging pusher;

a paper arranging rotation brush mechanism provided between said right wall surface and said left wall surface;

a motor; and a gear train for driving said cam mechanism and said paper arranging rotation brush mechanism by said motor;

wherein a side surface of the paper introduced into said binding table is pushed by said paper arranging pusher to carry out alignment in a transverse direction, and a surface of the paper is swept by said paper arranging rotation brush to carry out alignment in a longitudinal direction.

23. The document binding apparatus according to claim 22, further comprising an openable cover, and wherein said paper arranging mechanism further includes a tension coil spring and a crank pin to be rotated interlockingly with said paper arranging rotation brush, and wherein said paper arranging rotation brush is provided on said openable cover, and said crank pin is coupled to said cover through said tension coil spring, and said paper arranging rotation brush is returned to an initial rotation position by tensile force of said tension coil spring when said cover is opened.

24. A document binding apparatus for externally attaching to a printer apparatus, comprising:

a paper lead-in roller mechanism for leading a paper discharged from the printer apparatus;

a paper arranging mechanism for aligning a position of the paper;

a paper binding mechanism for binding the paper;

a paper discharge roller mechanism for discharging the paper, wherein said paper binding mechanism is a electromotive stapler including a clincher and a driver and fixed into such a position that a staple hits on a corner portion of the paper put on said binding table, and wherein a side edge portion of the paper enters a portion between said clincher and said driver and runs during lead-in of the paper, and the corner portion of the paper accumulated on said binding table is bound by said electromotive stapler;

an openable cover including a paper guide provided on a back face thereof for controlling an upper limit position of the side edge portion of the paper, said cover covering said electromotive stapler and said binding table, wherein the side edge portion of the paper is guided to a portion between said clincher and said driver by said paper guide.

25. The document binding apparatus according to claim 24, wherein said paper guide of said cover is provided immediately before said electromotive stapler in a state that said cover is closed.

26. A document binding apparatus for externally attaching to a printer apparatus, comprising:

a paper lead-in roller mechanism for leading a paper discharged from the printer apparatus;

a paper arranging mechanism for aligning a position of the paper;

a paper binding mechanism for binding the paper;

a paper discharge roller mechanism for discharging the paper, wherein said paper binding mechanism is a electromotive stapler including a clincher and a driver and fixed into such a position that a staple hits on a corner portion of the paper put on said binding table, wherein a side edge portion of the paper enters a portion between said clincher and said driver and runs during lead-in of the paper, and the corner portion of the paper accumulated on said binding table is bound by said electromotive stapler, and wherein a surface of said binding table is provided with non-slip treatment preventing misalignment of the arranged paper.

27. The document binding apparatus according to claim 26, wherein the non-slip treatment is a non-slip member having a high coefficient of friction relative to a coefficient of friction between the sheets of paper and provided by one of sticking and coating.

28. The document binding apparatus according to claim 27, wherein said non-slip member is a rubber sheet.

29. The document binding apparatus according to claim 26, wherein the non-slip treatment is a non-slip processing directly carried out over said surface of said binding table.

30. A method of binding a document by a document binding apparatus externally attached to a printer apparatus, said method comprising the steps of:

leading a paper discharged from the printer apparatus;

aligning a position of the paper;

binding the paper; and discharging the paper, wherein said steps of leading the paper, aligning the position of the paper, binding the paper and discharging the paper are sequentially executed, wherein said document binding apparatus includes a paper feeding motor;

said step of leading the paper is executed when the paper feeding motor is rotated in a forward direction; and said step of discharging the paper is executed when the paper feeding motor is rotated in a reverse direction.

31. A method of binding a document according to claim 30, further comprising the step of:

detecting the paper discharged from the printer apparatus.

32. The method of binding a document according to claim 31, wherein said step of detecting the paper is executed by pushing a lever provided to the document binding apparatus.

33. The method of binding a document according to claim 31, further comprising the step of:

comparing a continuation time taken after termination of detecting the paper with a reference time, wherein:

said step of leading the paper starts in response to detection of the paper;

said step of aligning the position of the paper starts in response to the termination of detecting the paper;

said step of binding the paper starts when the continuation time exceeds the reference time; and said step of discharging starts after said step of binding.

34. The method of binding a document according to claim 33, further comprising the step of:

measuring the number of detection of the paper discharge from the printer apparatus, wherein said step of binding starts if the number of the detection is two or more.

35. The method of binding a document according to claim 30, further comprising the step of:

moving and entering a side edge portion of the paper between a clincher and a driver of a stapler provided to said document binding apparatus before binding the paper.

36. The method of binding a document according to claim 30, further comprising the step of:

entering a side edge portion of the paper between a clincher and a driver of a fixed stapler provided to said document binding apparatus before binding the paper.

* * * * *